US007331480B1

(12) United States Patent
Nolan

(10) Patent No.: US 7,331,480 B1
(45) Date of Patent: Feb. 19, 2008

(54) ARTICULATED HINGE APPARATUS AND RELATED METHODS

(76) Inventor: Roger Nolan, 1217 Kensington Dr., Seymour, IN (US) 47274

( * ) Notice: Subject to any disclaimer, the term of this patent is extended or adjusted under 35 U.S.C. 154(b) by 634 days.

(21) Appl. No.: 10/256,631

(22) Filed: Sep. 27, 2002

(51) Int. Cl.
*B65D 6/18* (2006.01)
*B65D 8/14* (2006.01)

(52) U.S. Cl. ..... 220/7; 220/6

(58) Field of Classification Search ..... 220/6, 220/7; 16/229, 230, 380; 217/12 R, 13–15
See application file for complete search history.

(56) References Cited

U.S. PATENT DOCUMENTS 3,924,293 A * 12/1975 Cain ..... 16/380
3,977,044 A * 8/1976 Mort ..... 16/380
4,591,065 A 5/1986 Foy
4,775,068 A 10/1988 Reiland et al.
4,917,255 A 4/1990 Foy et al.
4,967,927 A 11/1990 Reiland et al.
5,094,356 A 3/1992 Miller
5,199,592 A 4/1993 Reiland et al.
5,398,835 A 3/1995 Blinstrub
5,474,197 A 12/1995 Hillis et al.
5,586,675 A 12/1996 Borsboom et al.
5,938,059 A 8/1999 Luburic
6,088,239 A * 7/2000 Zeiss ..... 361/809
6,283,319 B1 9/2001 Hillis et al.
6,305,566 B1 10/2001 Pigott et al.
6,838,616 B2 * 1/2005 Harrison et al. ..... 174/50

FOREIGN PATENT DOCUMENTS

EP 0485672 A1 5/1992

* cited by examiner

*Primary Examiner*—Anthony D. Stashick
*Assistant Examiner*—Harry A Grosso
(74) *Attorney, Agent, or Firm*—Schwartz Cooper Chartered

(57) ABSTRACT

Apparatus and methods for hinging or otherwise easily engaging and disengaging various members to each other include a spring-actuated pin element to selectively extend and retract a pin from one hinge leaf to engage an adjacent structure. A variety of spring elements may be used, and the hinge may be combined with other hinge elements in a variety of ways, including an articulated hinge. Methods of fabrication and assembly are disclosed.

19 Claims, 39 Drawing Sheets

ARTICULATED HINGE APPARATUS AND RELATED METHODS

BACKGROUND OF THE INVENTION

This invention relates generally to hinges, and specifically to apparatus and methods for easily engaging and disengaging various members to each other in a hinged or similar relationship. The invention is illustrated in connection with various components of a collapsible container, but it has a wide range of applications and uses other than for collapsible containers.

A wide variety of hinges and other structures exist to engage elements to each other. Among the many examples are collapsible storage containers, such as those illustrated in U.S. Pat. No. 4,917,255 to Foy et al. and U.S. Pat. No. 5,938,059 to Luburic, the disclosures of which are incorporated herein by reference. Despite the many advantages of certain prior art designs, most remain relatively difficult to disengage from each other (such as may be necessary for maintenance or replacement of damaged elements, to permit more ergonomic use of the assembly by a person, or the like).

Some hinged elements are so difficult to disengage from each other that, during some accidents, significant damage or failure occurs in the major (i.e. relatively expensive) components that the hinges are joining. For example, if a passing forklift accidentally snags an open drop door in a manufacturing plant, prior art hinges may tend to not disengage, the drop door or sidewall may be broken by the forklift.

OBJECTS AND ADVANTAGES OF THE INVENTION

It is, therefore, an object of the invention to provide an improved apparatus and methods for hinging or otherwise temporarily engaging two elements to each other, that facilitates easy disengagement at some point in the future.

Another object of the invention is the provision of a hinge apparatus, including a leaf portion, a first pin head member housed in the leaf portion, and a spring member forcing an end of the first pin head member to extend from the leaf portion. Preferably, the apparatus includes a second pin head member housed in the leaf portion, and a spring member forcing an end of the second pin head member to extend from the leaf portion, and the first and second pin head members extend coaxially in opposite directions from each other and are forced to extend in their respective directions by a single spring element positioned between them.

A further object of the invention is the provision of a plurality of hinges of the aforementioned character, in which the first and second pin head members of all such hinges are coaxially aligned along a side of a first element to be hinged to a second element.

An additional object of the invention is the provision of a hinge of the aforementioned character, including a second hinge rod member within the leaf portion, the axis of rotation of the second hinge rod member in spaced parallel alignment with the axis of rotation of the first pin head member. The second hinge rod member can be a wide range of types, including another hinge of the aforementioned character, a non-collapsible rod that can float transversely to the axes of rotation within a slot formed in the leaf portion, or others. For floating rod embodiments, detent means can be provided within the slot to temporarily hold the non-collapsible rod at a selected location within the slot while permitting hinged rotation about the non-collapsible rod.

Yet another object of the invention is the provision of a hinge of the aforementioned character, in combination with a container sidewall and a drop door positionable within that drop door. One of the first pin head member and the non-collapsible rod can permit rotation between the container sidewall and the leaf portion, and the other of the first pin head member and the non-collapsible rod can permit rotation between the drop door and the leaf portion. The spring-loaded hinge of the invention can likewise be used to removably and temporarily hinge a collapsible sidewall to a container base.

Preferably, an access port or window is provided adjacent each spring member to allow ready compression of the spring member (such as by a user squeezing the spring with his or her fingers or with a screwdriver, key, or similar implement) and corresponding disengagement of the two the elements hinged or engaged by the first pin head member. The disengagement can occur, for example, via corresponding axial movement of the pin head member back toward the leaf portion. For some applications, however, it may be desirable that the hinge not be readily disengaged, such as for safety purposes. Accordingly, embodiments for such applications may not include access ports or windows.

An additional object of the invention is the provision of an articulated hinge, including an intermediate leaf member positioned between a first hinged element and a second hinged element, a first hinge pin acting between the first hinged element and the leaf member, and a second hinge pin acting between the second hinged element and the leaf member. The first hinge pin preferably has two pin head members normally urged by a spring member toward a first position extending from the leaf member into engagement with the first hinged element, with the spring member being selectively compressible to permit disengagement of the leaf member from the first hinged element. As indicated above, among the many applications for this invention is use on collapsible container components such as sidewalls and drop doors.

A further object of the invention is the provision of a collapsible container assembly, including a sidewall member, a drop door disposed therein, and a hinge apparatus of the aforementioned character acting between the sidewall member and the drop door.

A still further object of the invention is the provision a method of hinging a first collapsible container member to a second collapsible container member. The method preferably includes providing a hinge apparatus of the aforementioned character with the leaf portion operably affixed to the first collapsible container member, compressing the spring member to permit the first pin head member to retract toward the leaf portion, aligning the first pin head member with a corresponding opening in the second collapsible container member, and allowing the spring member to force the end of the first pin head member to extend from the leaf portion into the corresponding opening in the second collapsible container member.

Another object of the invention is the provision a method of assembling a drop door within a collapsible container sidewall. The method preferably includes providing a hinge of the aforementioned character (having a floating non-collapsible rod), and providing a drop door with an interference fit to snappingly receive the non-collapsible rod and thereafter permit rotation of the drop door about the non-collapsible rod. The drop door preferably further includes at least one flange to prevent excessive movement of the non-collapsible rod in the direction of the longitudinal axis of the non-collapsible rod once the rod is engaged in the interference fit. Other steps can include placing the non-collapsible rod into through the slot in the leaf portion and snappingly engaging that assembly into the drop door interference fit, providing pin head guide surfaces on the sidewall to force the first pin head member to compress the spring member as the leaf portion is pushed into desired alignment with the sidewall, and forcing the leaf portion into desired alignment with the sidewall so that the end of the first pin head member first retracts into and then extends from the leaf portion into a corresponding opening in the sidewall.

An additional object of the invention is the provision of a hinge of the aforementioned character, further including detent means acting between the first pin head member and the leaf portion to keep the spring member from forcing the first pin head member out of the leaf portion.

Yet another object of the invention is the provision of a method of fabricating the hinge apparatus of the aforementioned character. The method preferably includes providing the aforementioned detent means on the first pin head member, molding the leaf portion to include a generally round opening therein, the round opening configured to closely fit and support the first pin head member in a rotatable relationship, the leaf portion further including a detent receiving structure remote from the end of the first pin head member, the round opening comprising an interference fit with respect to the detent on the first pin head member; and forcing the detent on the first pin head member through the interference fit to engage the first pin head member with the leaf portion. Other steps can include inserting a spring member into the round opening prior to forcing the detent on the first pin head member through the interference fit, and forcing the detent on the first pin head member through the interference fit while the leaf portion is still pliable from the molding step.

An additional object of the invention is the provision of apparatus for removably engaging a first thing to a second thing, including a first pin head member housed in the first thing, and a spring member forcing an end of the first pin head member to normally extend from the first thing into engagement with the second thing, the spring member being selectively collapsible to permit disengagement of the end of the first pin head member from the second thing.

Another object of the invention is the provision of an improved method and apparatus for more easily connecting and disconnecting various components to each other. Examples include swing arms in hand held totes and other containers, among many others.

A further object of the invention is the provision of a hinge/engagement apparatus of the foregoing character that permits a designed-in stress failure point within a relatively inexpensive part of the assembly. Rather than damaging an entire sidewall or drop door, for example, the pin head members of the invention can be sized and configured so that they deform or even disengage during some accidents, thus avoiding significant damage to or failure in the major components that they are joining. In the foregoing example of a passing forklift accidentally snagging an open drop door in a manufacturing plant, the pin head member of the hinge of the invention can simply bend or deform under the forklift's force, and even be pulled out of engagement from the sidewall. The hinge leaf member and the hinge pins may need to be replaced following such an accident, but that is much less expensive and more readily done than replacing an entire drop door or sidewall.

Other objects and advantages of the invention will be apparent from the following specification and the accompanying drawings, which are for the purpose of illustration only.

BRIEF DESCRIPTION OF THE DRAWINGS

FIGS. 19*b-e* are similar to FIG. 18, but illustrate the gradual movement or traverse (progressively through each figure) of the non-collapsible hinge rod across the slot in the hinge leaf member;

DESCRIPTION OF PREFERRED EMBODIMENTS

Figure 1:
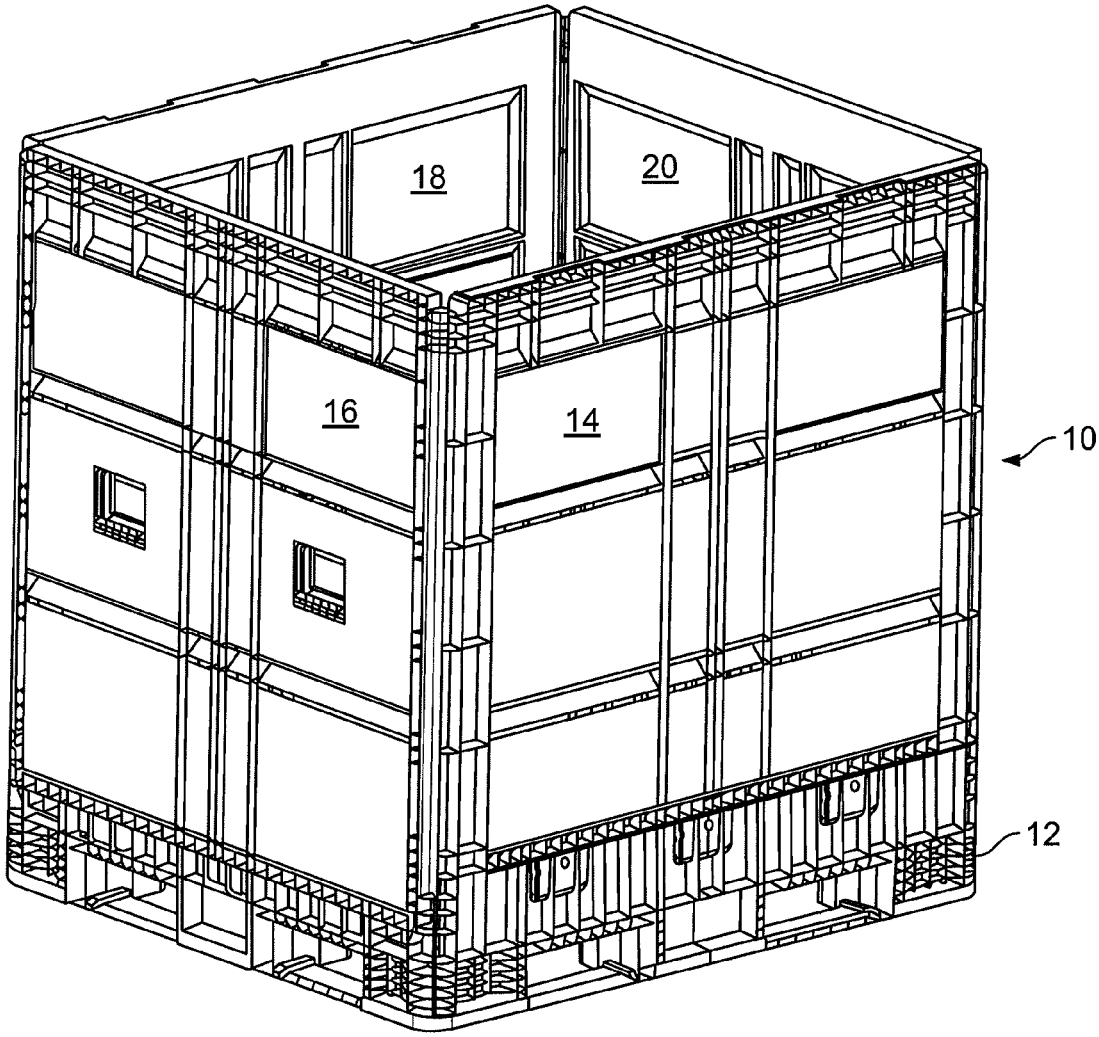
FIG. 1 is a perspective view of a preferred embodiment of a collapsible container incorporating the invention, with the sidewalls in their erected position.

As shown in FIG. 1, a preferred embodiment of the invention includes a collapsible container 10 having a base 12 and sidewalls 14, 16, 18, and 20 pivotally attached to the base. Any suitable means can be used to maintain the sidewalls in their upright configuration shown in FIG. 1.

Persons of ordinary skill in the art will understand that the components discussed herein can be fabricated from any of a wide variety of materials and processes. Preferably, the components are lightweight but suitably strong to withstand the loads and forces they may encounter during use. Among others, high/low pressure plastic injection molding, structural foam molding, or blow-molding can be readily utilized to form lightweight components or structures embodying the invention, for storage, transport, and handling of a wide variety of solid and liquid materials and things. Other fabrication methods include, by way of example, compression molding, rotational molding, gas/water assist molding, extrusion, or pultrusion. Persons of ordinary skill in the art will understand that other manufacturing processes and materials may be readily utilized.

Additional strength can be introduced into many embodiments of the invention by using engineered grade resins, and/or fillers such as mineral or glass fillers. Preferably, embodiments of the invention are fabricated from strong, lightweight materials sufficient to support substantial loads and forces encountered in transporting and handling relatively heavy materials. For less demanding applications, thinner webs and/or different material may be sufficient.

Although the preferred embodiments are illustrated to include drop doors and/or sidewalls for a collapsible container, persons of ordinary skill in the art will understand that the invention has broad utility. A wide range of components other than container components can be joined to each other using the invention and, if desired, can be readily and repeatedly disengaged from each other (for repair, maintenance, improved access to an assembly's interior, or the like).

Figure 2:
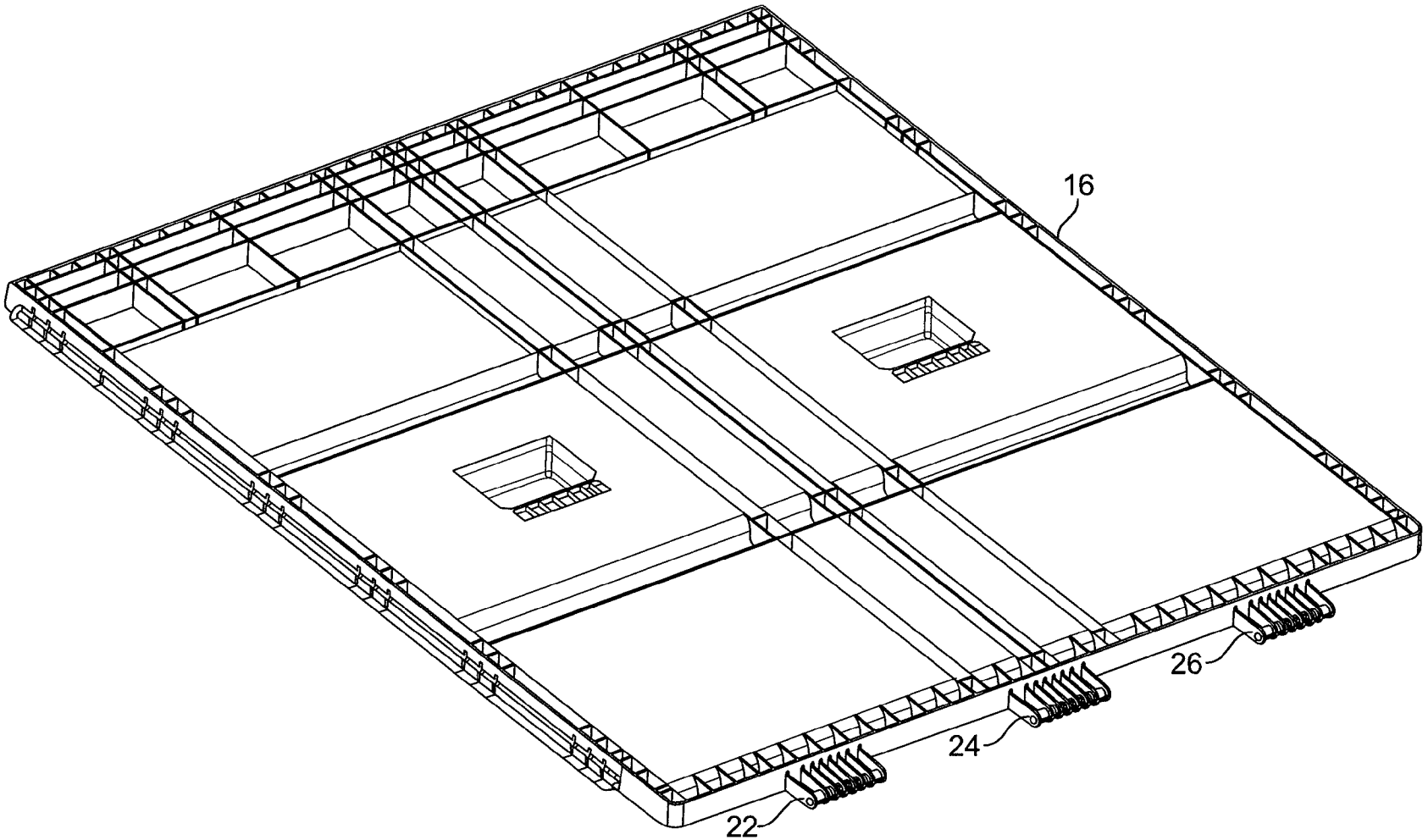
FIG. 2 is a perspective view of one of the sidewalls of the container of FIG. 1.
Figure 3:
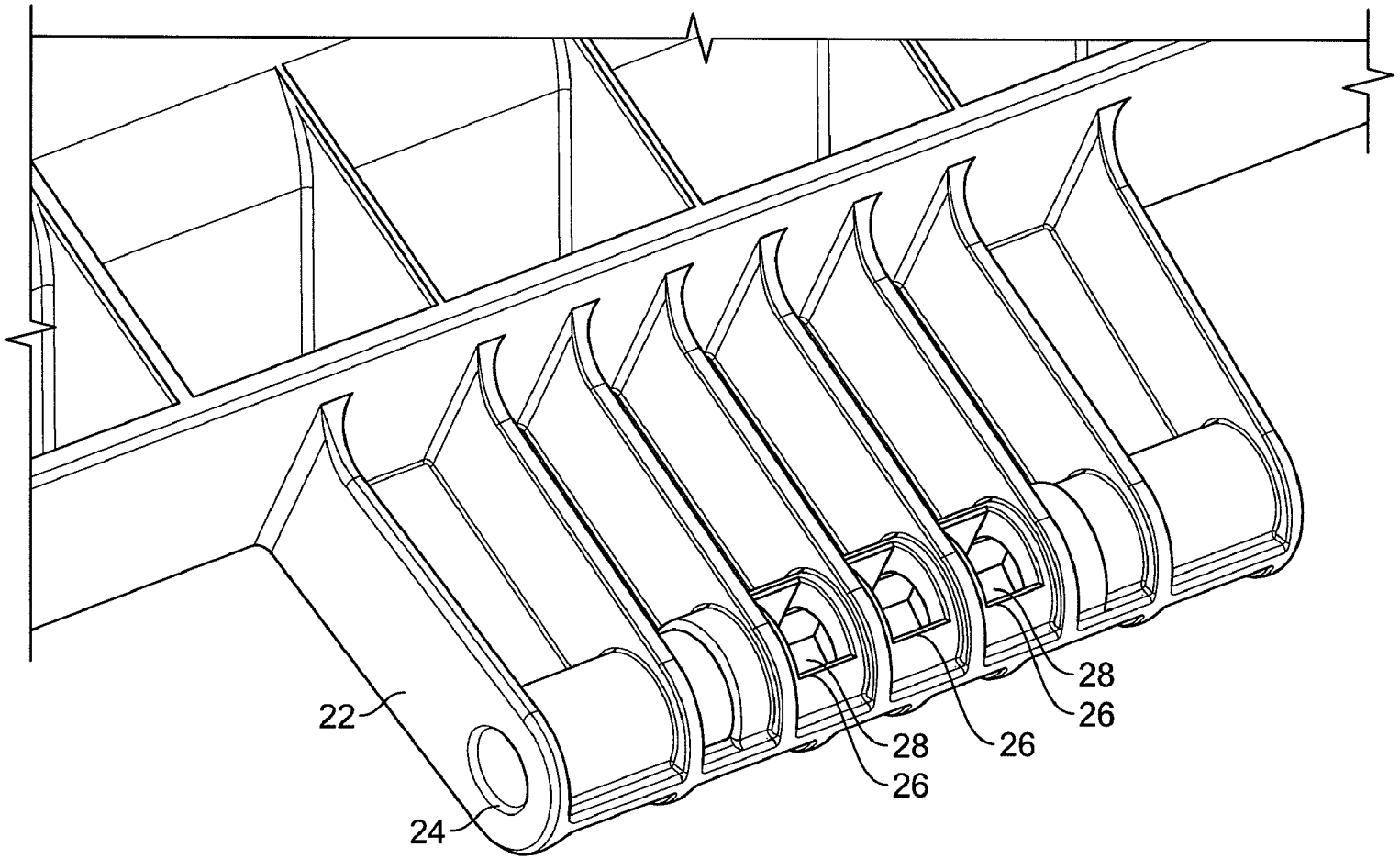
FIG. 3 is a close up view of one of the hinge leaf portions at the bottom of the sidewall of FIG. 2.
Figure 4:
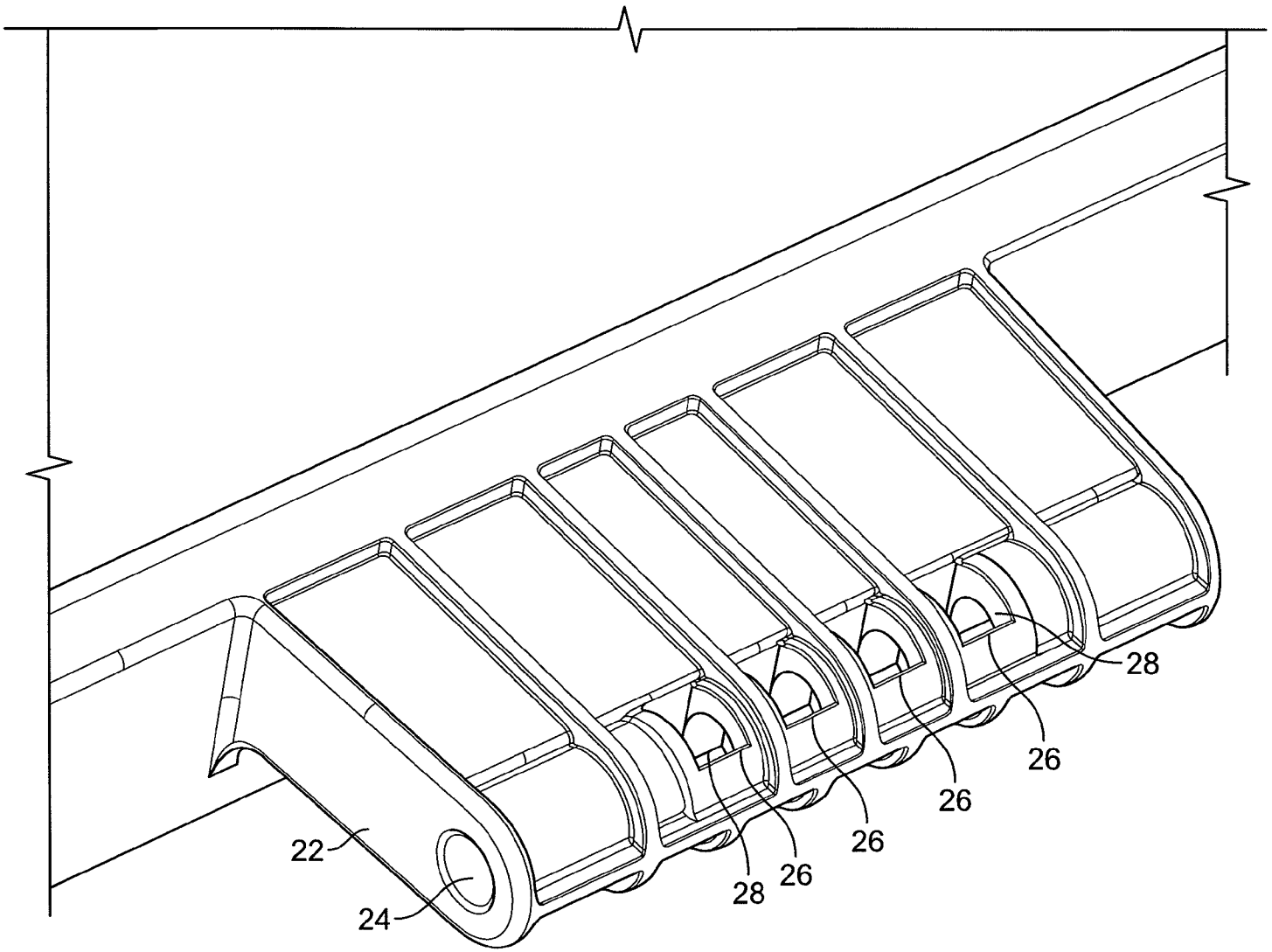
FIG. 4 is similar to FIG. 3, but shows the reverse side of the leaf portion.
Figure 5:
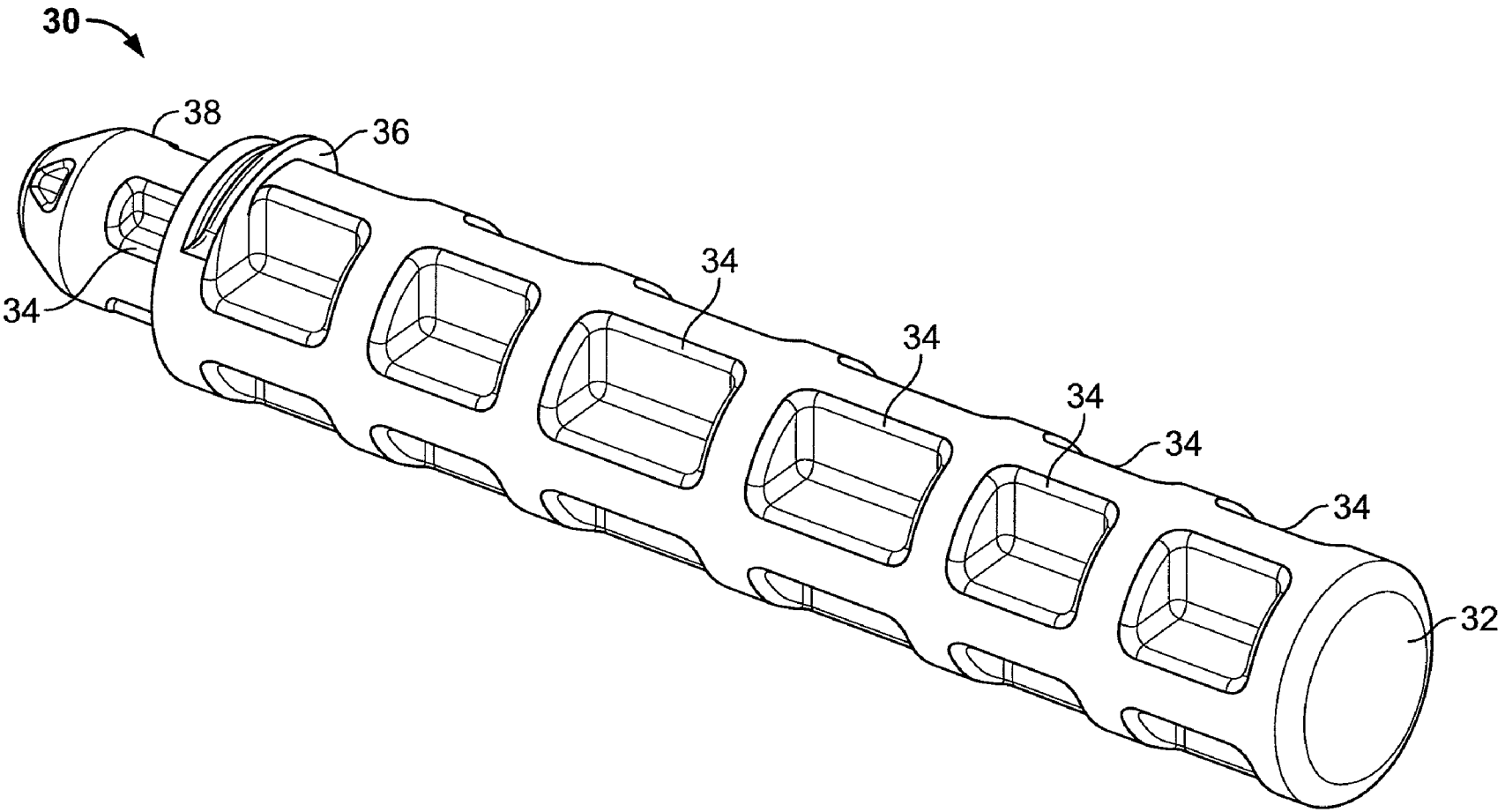
FIG. 5 is a perspective view of a preferred embodiment of a pin head member of the invention.
Figure 6:
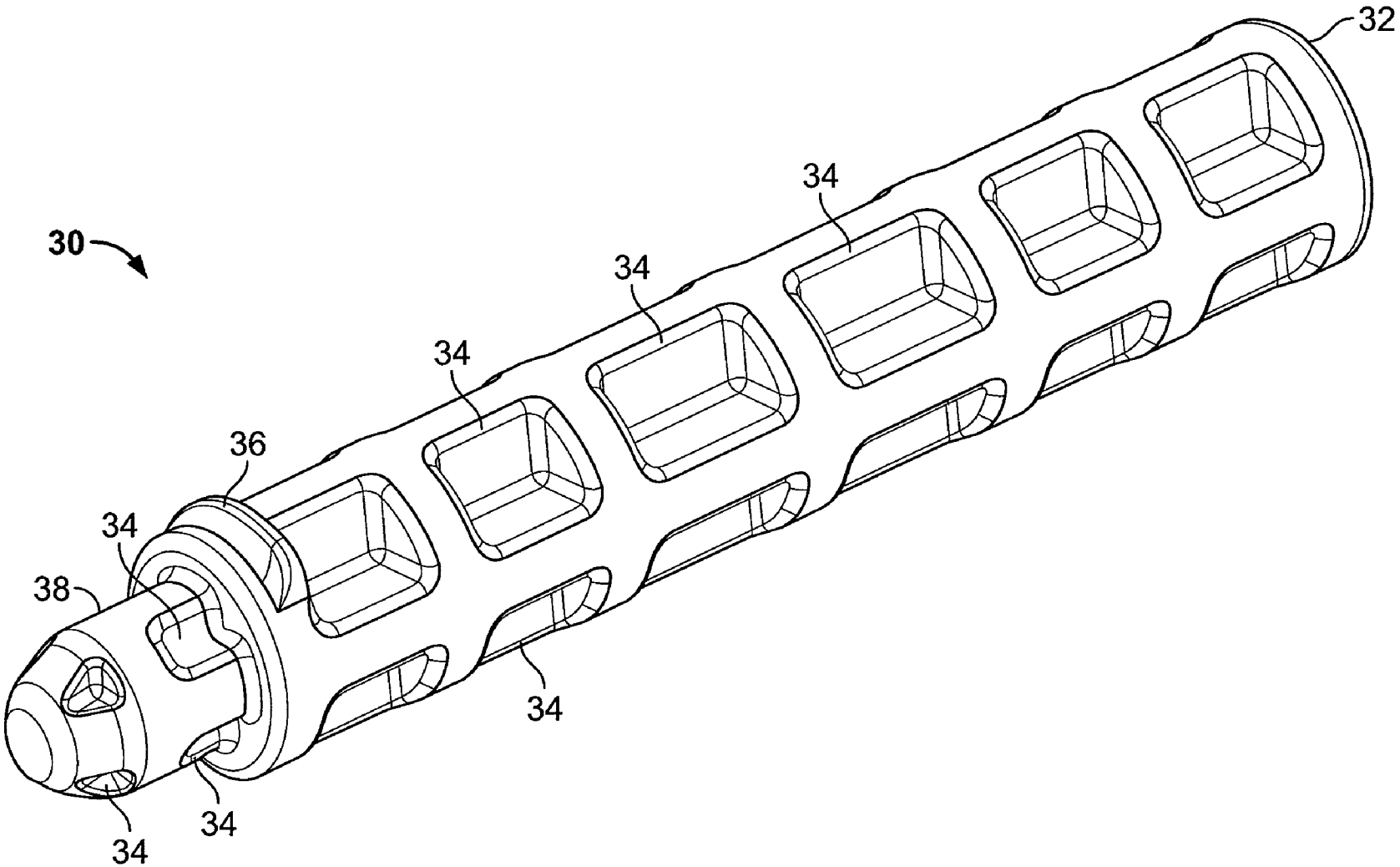
FIG. 6 is similar to FIG. 5, but illustrates the pin head as viewed from the other end.
Figure 7:
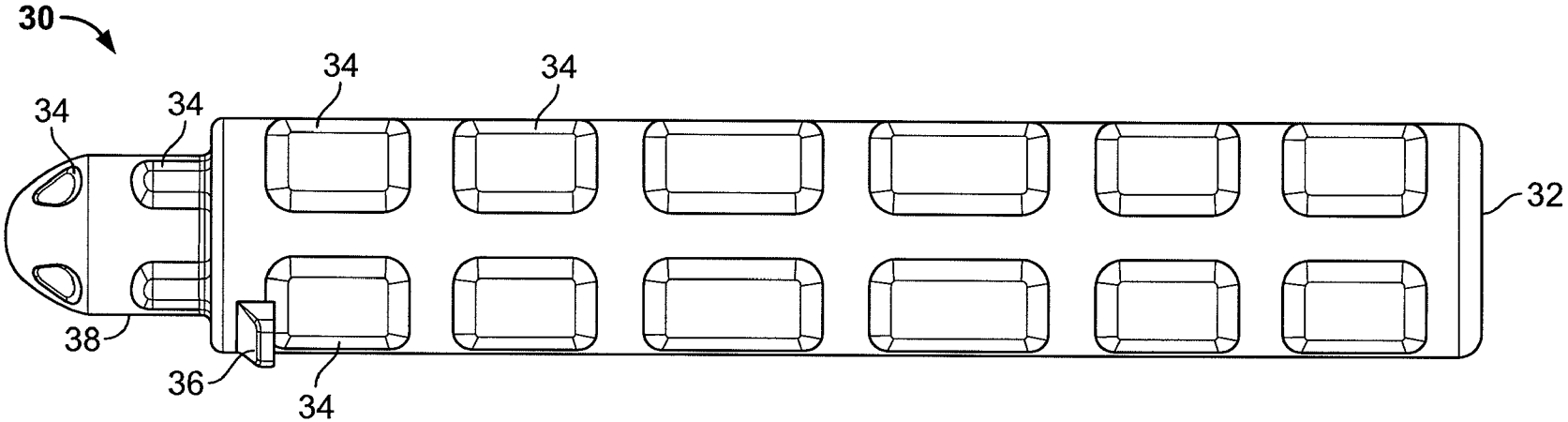
FIG. 7 is a top view of the pin head member of FIGS. 5 and 6.
Figure 8:
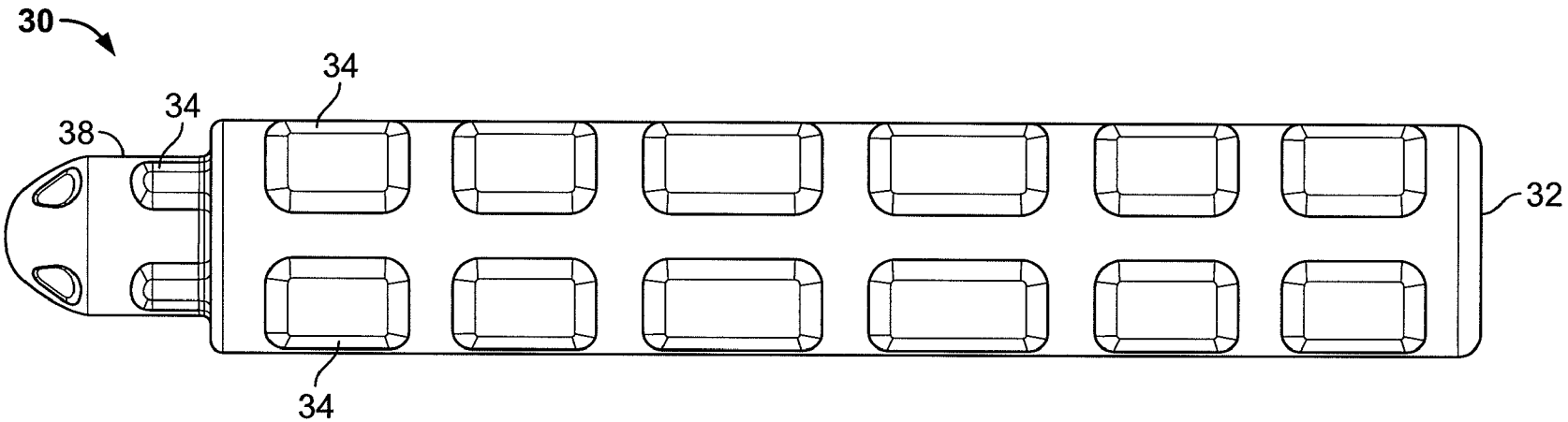
FIG. 8 is similar to FIG. 7, but shows the pin head member as rotated so that the detent means near the left end is away from the viewer.

As shown in FIGS. 2-4, the sidewalls such as sidewall 16 preferably can include integrally molded hinge leaf members such as members 22, 24, and 26. Persons of ordinary skill in the art will understand that the size, number, spacing, and other aspects of the hinge leaf members can be any of a wide range, depending on the application and conditions for which the embodiment is intended. Thus, although three such hinge leaf members are shown in FIG. 2, more or less could be used, a single long hinge leaf member could be provided across substantially the full width of the sidewall 16, etc.

Although opposing pairs of walls 14/18 and 16/20 are illustrated as being generally identical with each other, persons of ordinary skill in the art will understand that the walls could differ from each other (e.g., one or more could have a drop door, as discussed below) and still beneficially use the invention.

As best shown in FIGS. 3 and 4, the hinge leaf members preferably include an opening 24 therethrough configured to receive in a sliding relationship the spring member and pin head members discussed below, one or more access ports or windows 26, and detent engaging means 28. As further explained herein, persons of ordinary skill in the art will understand that, among the many alternative embodiments of the invention, certain applications may not require windows 26, and the spring member could be integrally formed with the hinge leaf member 22 (rather than being inserted into opening 24).

FIGS. 5-8 illustrate a preferred embodiment of a pin head member 30. Preferably, the pin head is configured in a generally elongated cylindrical shape with an end 32 that, normally will extend from the hinge leaf member 22, as explained herein. Persons of ordinary skill in the art will understand that suitable pin heads could be fabricated from a wide variety of materials and methods. By way of example, in alternative embodiments, they could be fabricated from steel and have stamped detents or even snap rings (see FIG. 36 and related discussion below) to provide the retention function of the detents discussed herein.

A preferred approach, however, is to use injection molded embodiments such as illustrated in FIGS. 5-8, due to costs, ease of replacement, ability to design the failure point of the assembly to be the relatively inexpensive pin head member (rather than the entire sidewall or other component), and other factors. To conserve materials, and to provide a strong, lightweight configuration that can be readily molded, the pin head member 30 preferably includes a plurality of pockets 34 formed along its length. At the opposite end from end 32, the pin head member 30 preferably includes a detent member 36 (to engage detent engaging means 28, as mentioned above) and a spring seating post section 38. Post section 38 preferably also includes pockets 34 that, in addition to the benefits mentioned above, can also facilitate disengagement of the pin head member from its assembled hinging/engagement relationship between two things (as further explained herein).

Figure 9:
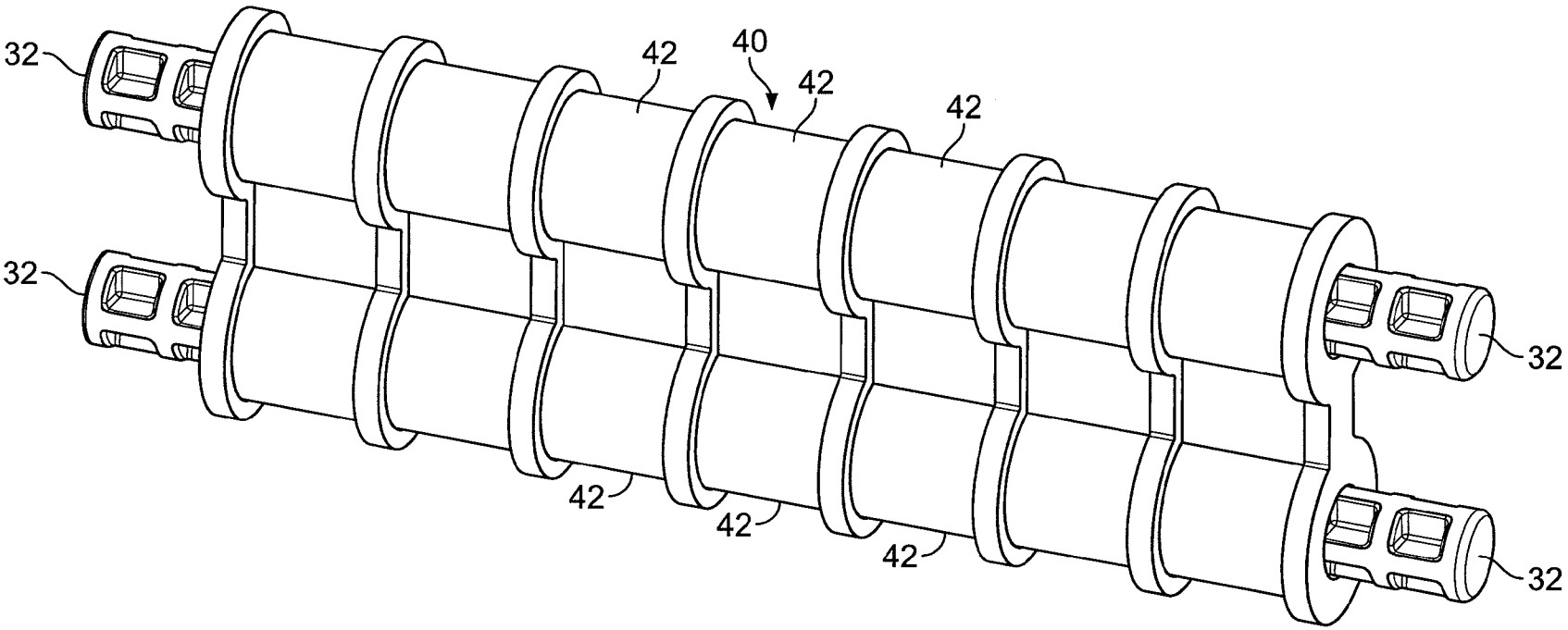
FIG. 9 is a perspective view of one of the many alternative embodiments of the invention, illustrating four pin head members assembled within a single hinge leaf portion.
Figure 10:
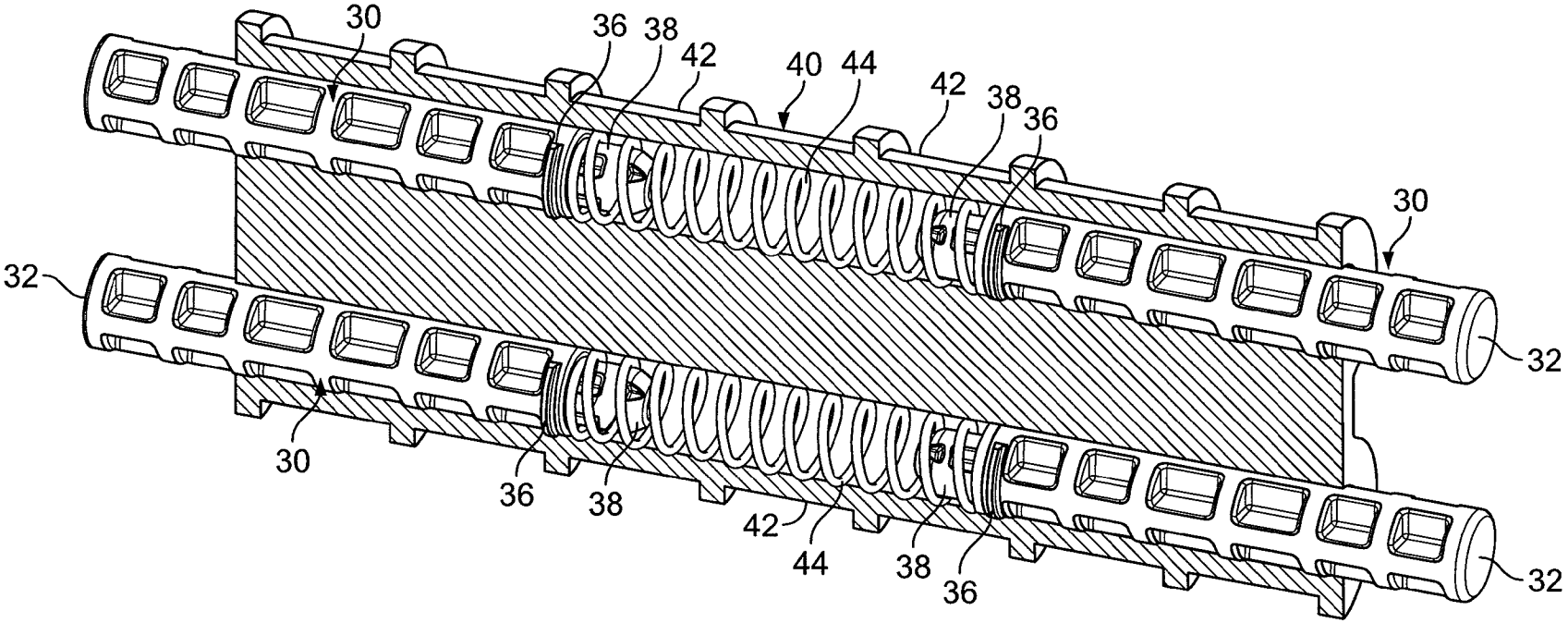
FIG. 10 is similar to FIG. 9, but is a partial sectional view, with the section taken only through the hinge leaf portion, and not through the pin head members or the spring member.
Figure 11:
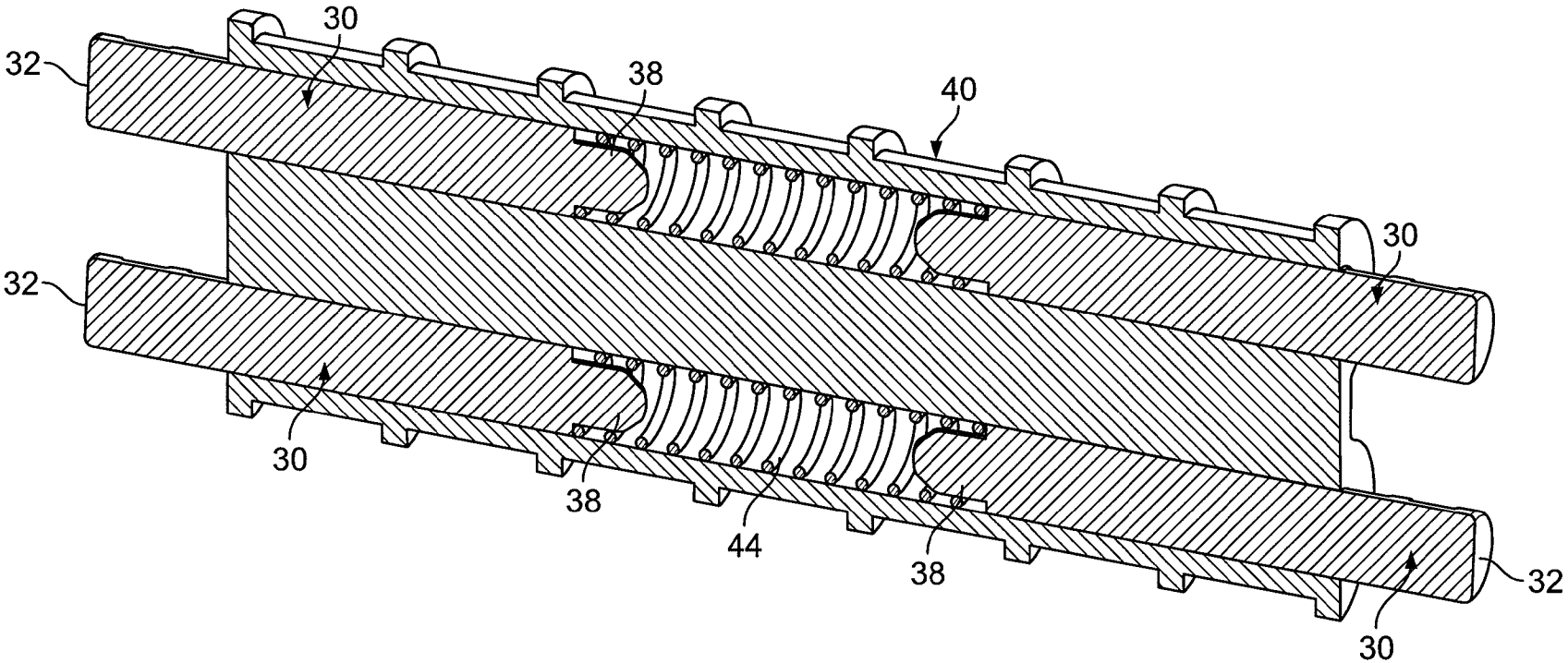
FIG. 11 is similar to FIG. 10, but shows sectioning of the pin head members and the spring member as well.

In one of the many alternative embodiments of the invention, four such pin head members 30 can be assembled within a molded housing 40 (see FIGS. 9-11). Persons of ordinary skill in the art will understand that such embodiments can be used to hinge together other pieces (not shown) and provide two axes of hinging (if each hinge axis is attached to a separate piece). Alternatively, the embodiment of FIGS. 9-11 could be used in many other applications, including by way of example as a handle inserted between opposing bores on a suitcase or other container. Although no access ports or windows are shown in this embodiment (which may be desirable for certain applications such as when the manufacturer does not want the parts to be disengaged from each other), such ports could readily be provided at locations such as areas 42 (via molding such openings, cutting, drilling, etc.).

FIGS. 10 and 11 illustrate a preferred spring member 44 of the invention, engaged with the spring seating post sections 38 of the pin head members 30. Although a single spring member 44 is shown as actuating opposing pairs of pin head members 30 and pushing them to extend ends 32 from the leaf portion 40, persons of ordinary skill in the art will understand that many alternative embodiments of spring members can be utilized. Among other things, multiple springs (not shown) could be provided for each pair of pin head members 30, a dividing flange (not shown) could be formed transversely across the center of housing 40 (resulting in a structure similar to FIG. 33, with a single spring member abutting the flange and exerting force on a single pin head member 30), etc.

As further explained below in connection with FIG. 20, the detents 36 preferably retain the pin head members 30 within the housing 40, and place their respective spring members 44 under sufficient compression to urge the ends 32 outward from the housing 40 and into engagement with an adjacent bore or other portion of an item to be hinged or engaged. Persons of ordinary skill in the art will understand that, for embodiments in which ease of disengagement is desired, the assembly also preferably permits a user (via a screwdriver, key, or similar implement, or via the user's fingers) to reach through an access port or window, contact the pockets 34 or other reachable parts of post section 38 and retract the pin head members 30 toward the middle of the housing 40. This withdraws the ends 32 inside housing 40 (or at least withdraws them from engagement with the other thing to which they are hinged), and permits ready removal of the entire assembly 40/30/44 from its hinged relationship with other things.

Persons of ordinary skill in the art will understand that the various methods and apparatus discussed above in connection with housing 40 and its interaction with spring members 44 and pin head members 30 apply to the leaf member 22 of FIGS. 2-4. Among other things, the assembly into opening 24 of two pin head members with a spring member between them, and the resulting spring-loaded hinge rod arrangement is generally the same (although only one spring-loaded hinge rod results in FIGS. 2-4, whereas two such hinge rods result in the embodiment of FIGS. 9-11).

Figure 12:
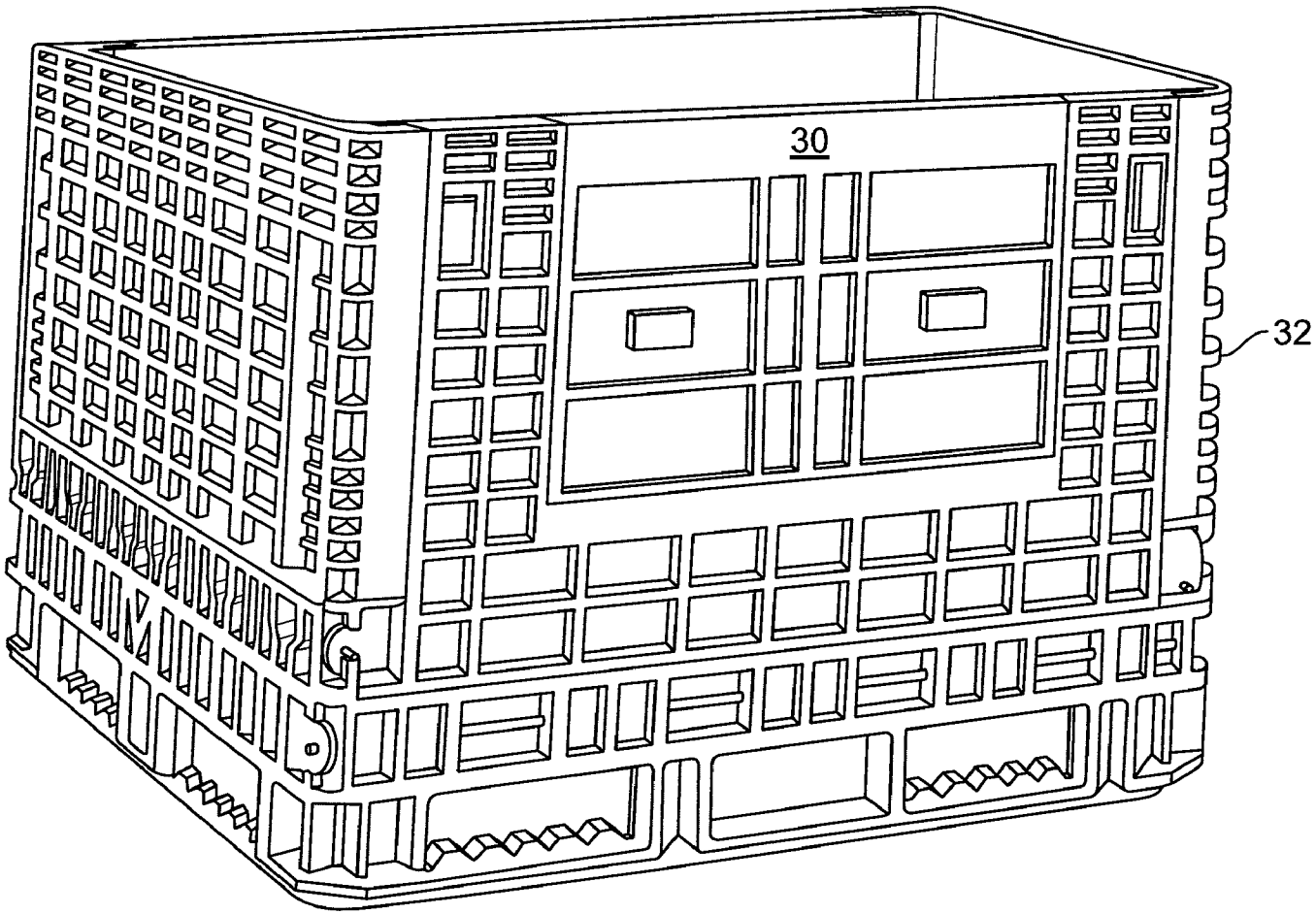
FIG. 12 is similar to FIG. 1, but illustrates one of the many alternative embodiments of a collapsible container in which the invention may be used, including a drop door provided in one of the container sidewalls.
Figure 12A:
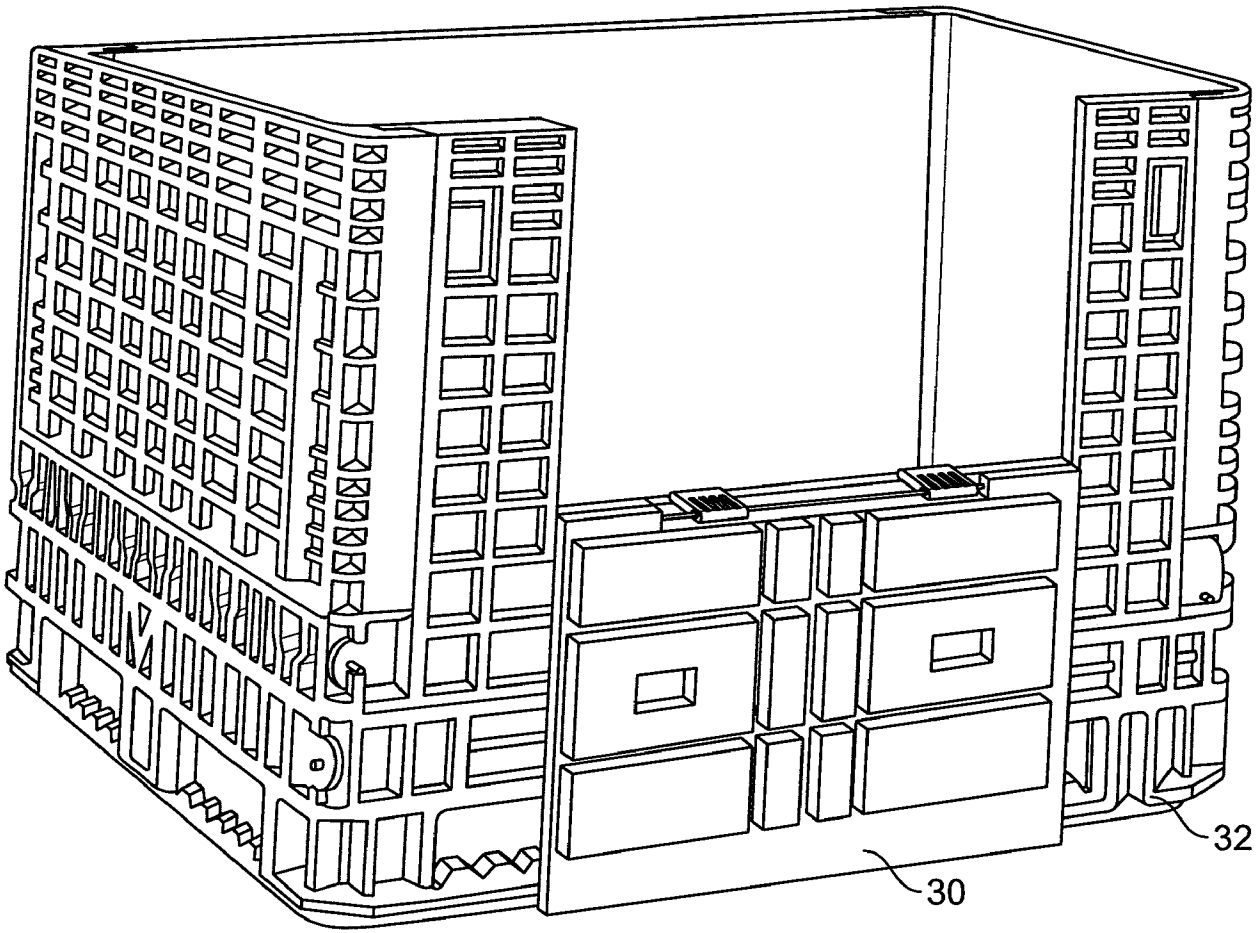
FIG. 12*a* is similar to FIG. 12, but shows the drop door in an opened position.
Figure 13:
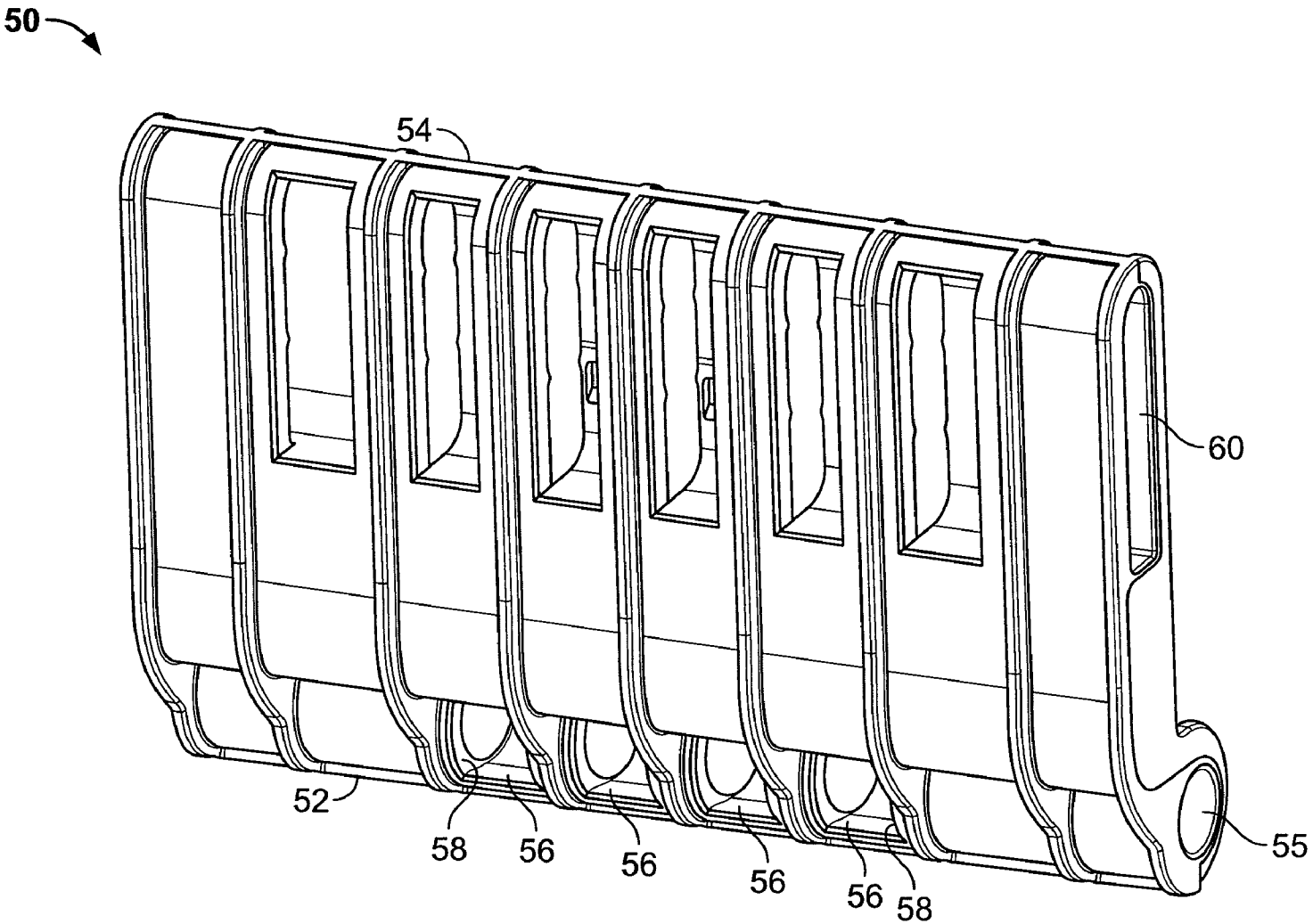
FIG. 13 is a perspective view of an articulated hinge leaf member useful in connection with drop door applications such as shown in FIGS. 12 and 12*a;*
Figure 14:
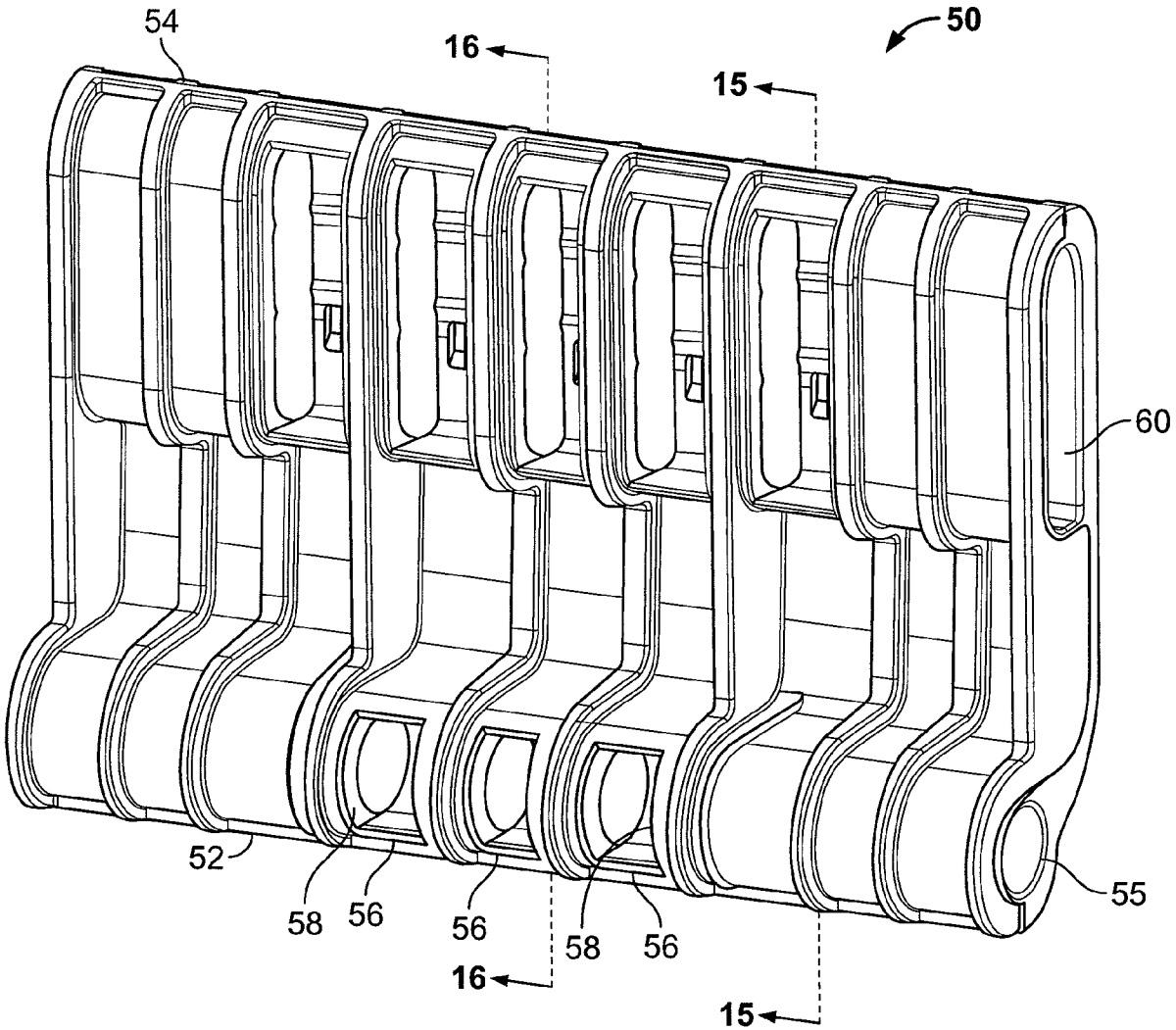
FIG. 14 is similar to FIG. 13, but shows the back side of the hinge leaf member.
Figure 15:
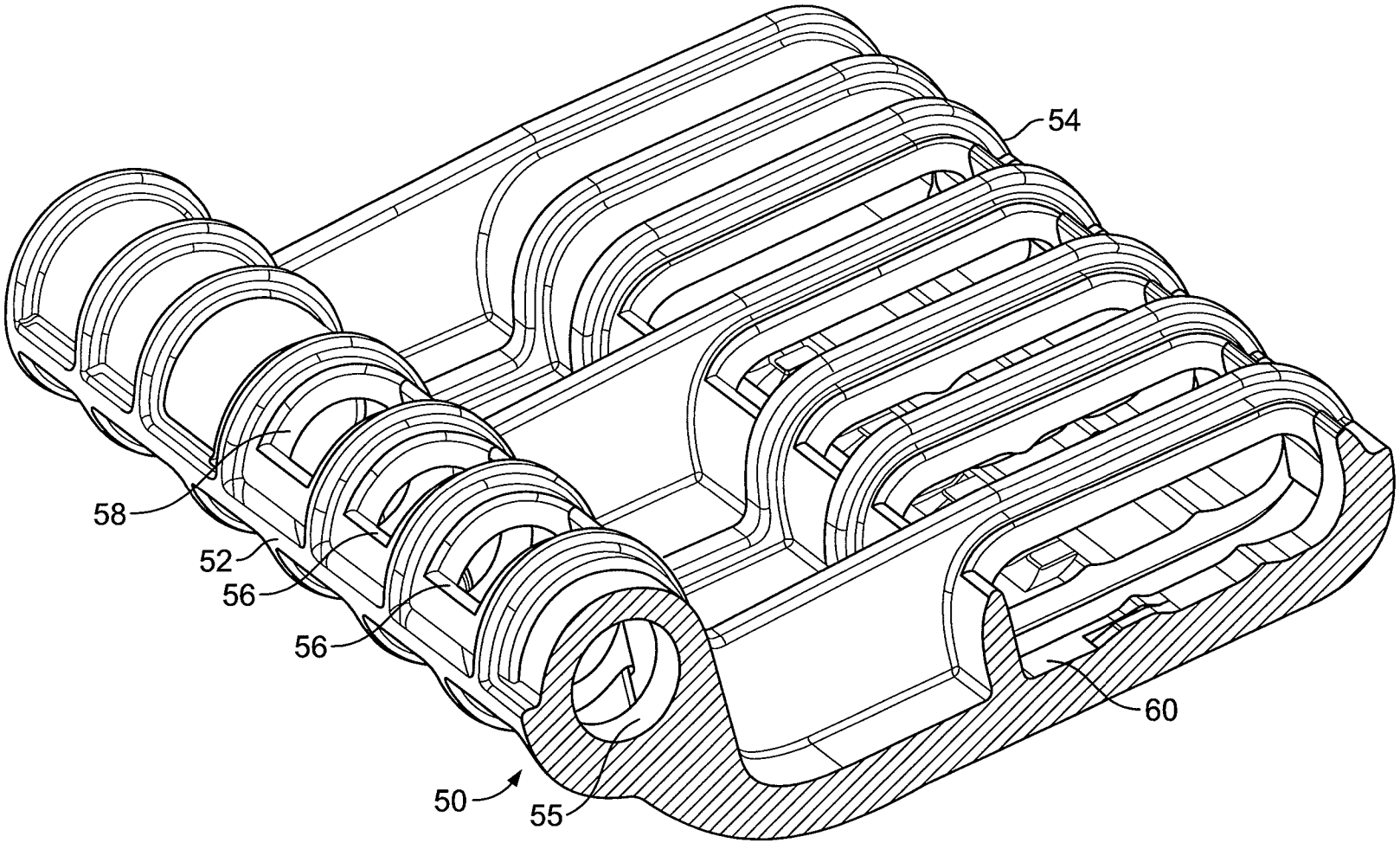
FIG. 15 is similar to FIG. 14, but is a perspective view showing a section cut at line 15-15 of FIG. 14.
Figure 16:
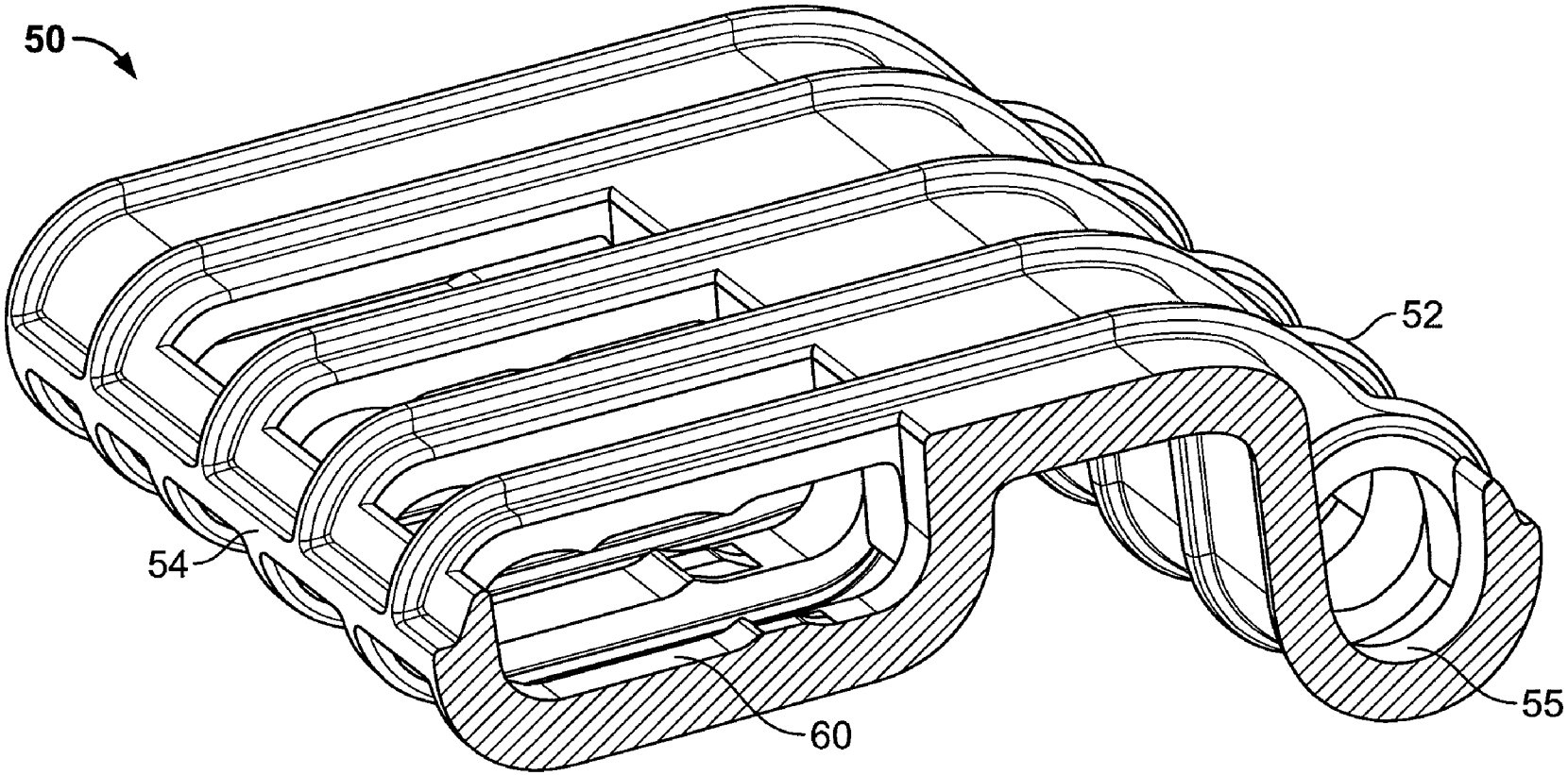
FIG. 16 is similar to FIG. 15, but is a perspective view showing a section cut at line 16-16 of FIG. 14, with the element also turned over to show its other side.
Figure 17:
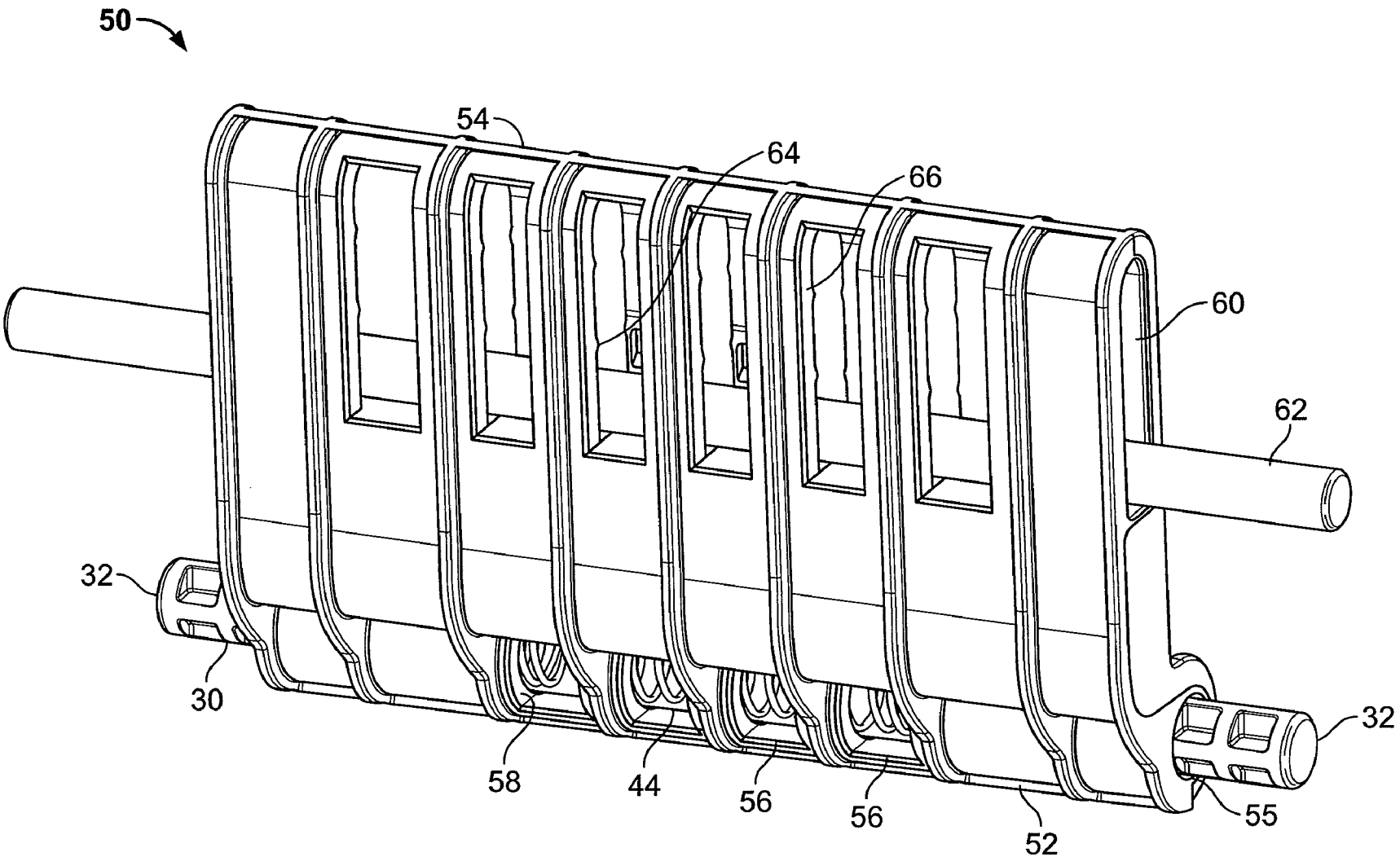
FIG. 17 is similar to FIG. 13, but shows the hinge leaf member assembled with two pin head members, a spring member, and a non-collapsible floating hinge rod.

FIGS. 12-32 illustrate the invention as used in a drop door within a collapsible container sidewall. The general operation of drop doors within such containers is shown by comparing FIG. 12 (with the drop door 30 of container 32 in the upright or closed position) and FIG. 12*a* (with the drop door 30 of container 32 in the down or open position). FIGS. 13-32 illustrate details of a preferred hinge apparatus for a drop door 100 similar to door 30 in FIGS. 12 and 12*a*.

Figure 24:
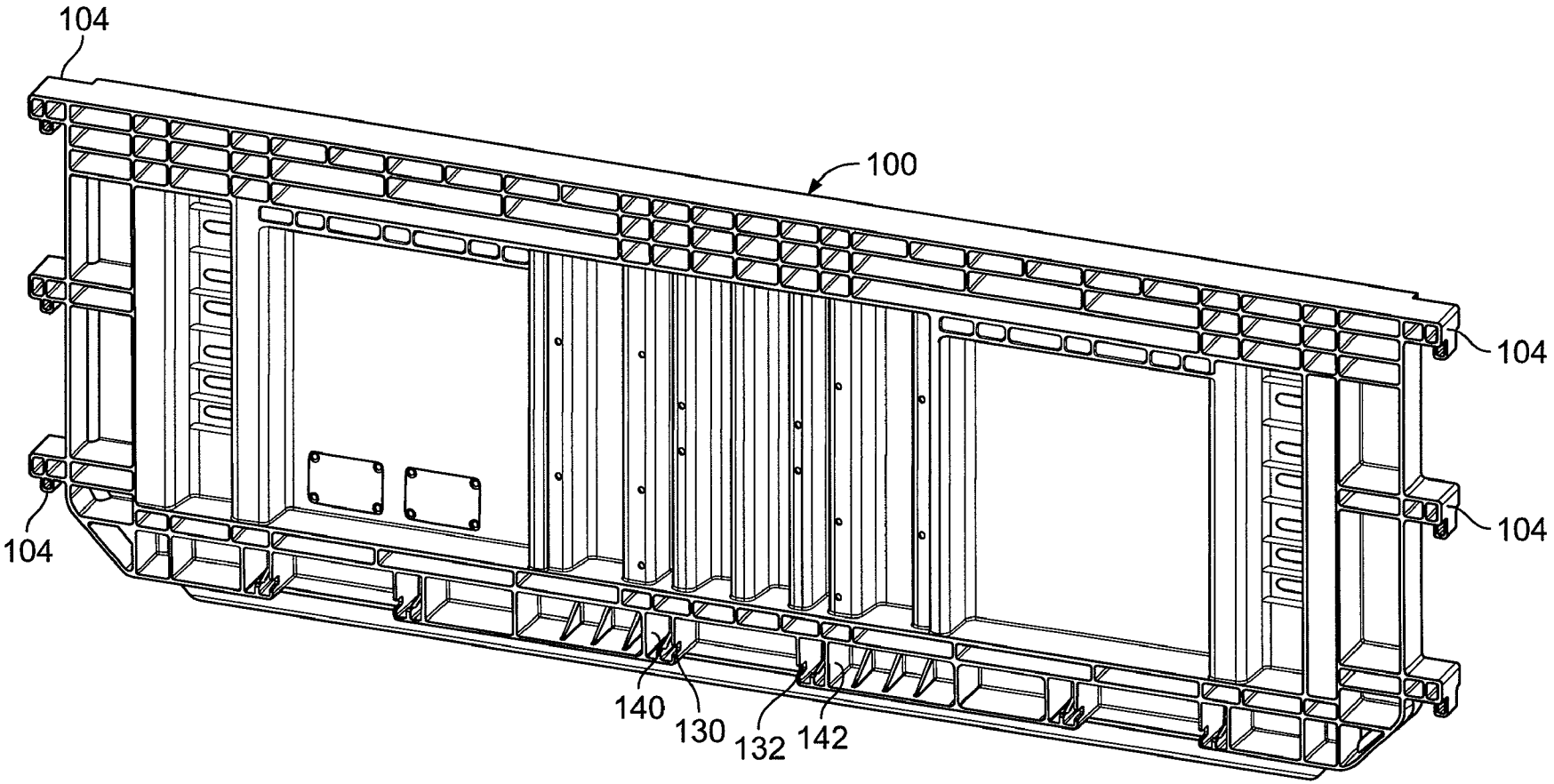
FIG. 24 is a preferred embodiment of a drop door of the invention, usable in a manner similar to that shown in FIGS. 12 and 12*a;*
Figure 25:
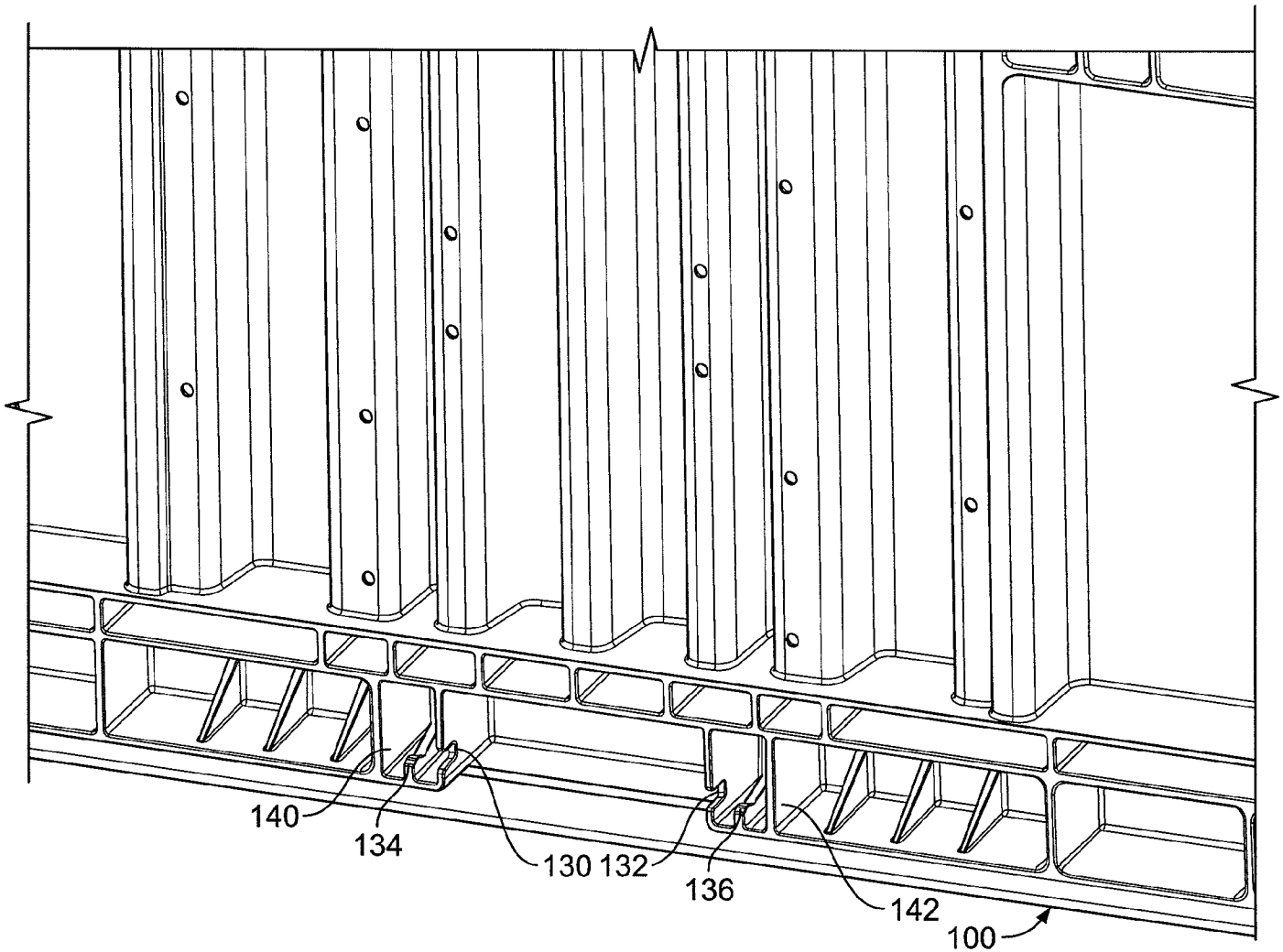
FIG. 25 is a close-up view of the bottom center portion of FIG. 24.

In the preferred embodiment of such drop door application, a preferred drop door such as door 100, FIG. 24, is hinged to the adjacent sidewall member in a manner that will now be described. Using the hinge discussed herein, hook members 104 can be dropped into corresponding pockets (not shown) on the sidewall to keep the door 100 in its erected position. To open and lower the drop door, the hinge permits the drop door 100 to be raised relative to the sidewall (to disengage the hooks 104 from their corresponding pockets on the sidewall) and then swung outwardly and even laid flat against the outside of the sidewall in a confronting, parallel relationship with that sidewall.

Among the variety of ways in which the invention can be used to hinge two items to each other, such as a drop door hinged to a collapsible container sidewall, an articulated hinge structure can be useful. FIGS. 13-16 illustrate a preferred intermediate hinge leaf member 50 having a first portion 52 and a second portion 54 (for a floating hinge pin, as will be described below). Among other things, persons of ordinary skill in the art will understand that the floating hinge portion 54 of member 50 permits the desired upward and downward movement of the drop door 100 relative to the sidewall, for engagement and disengagement of the hooks 104 from their associated pockets on the sidewall.

Figure 18:
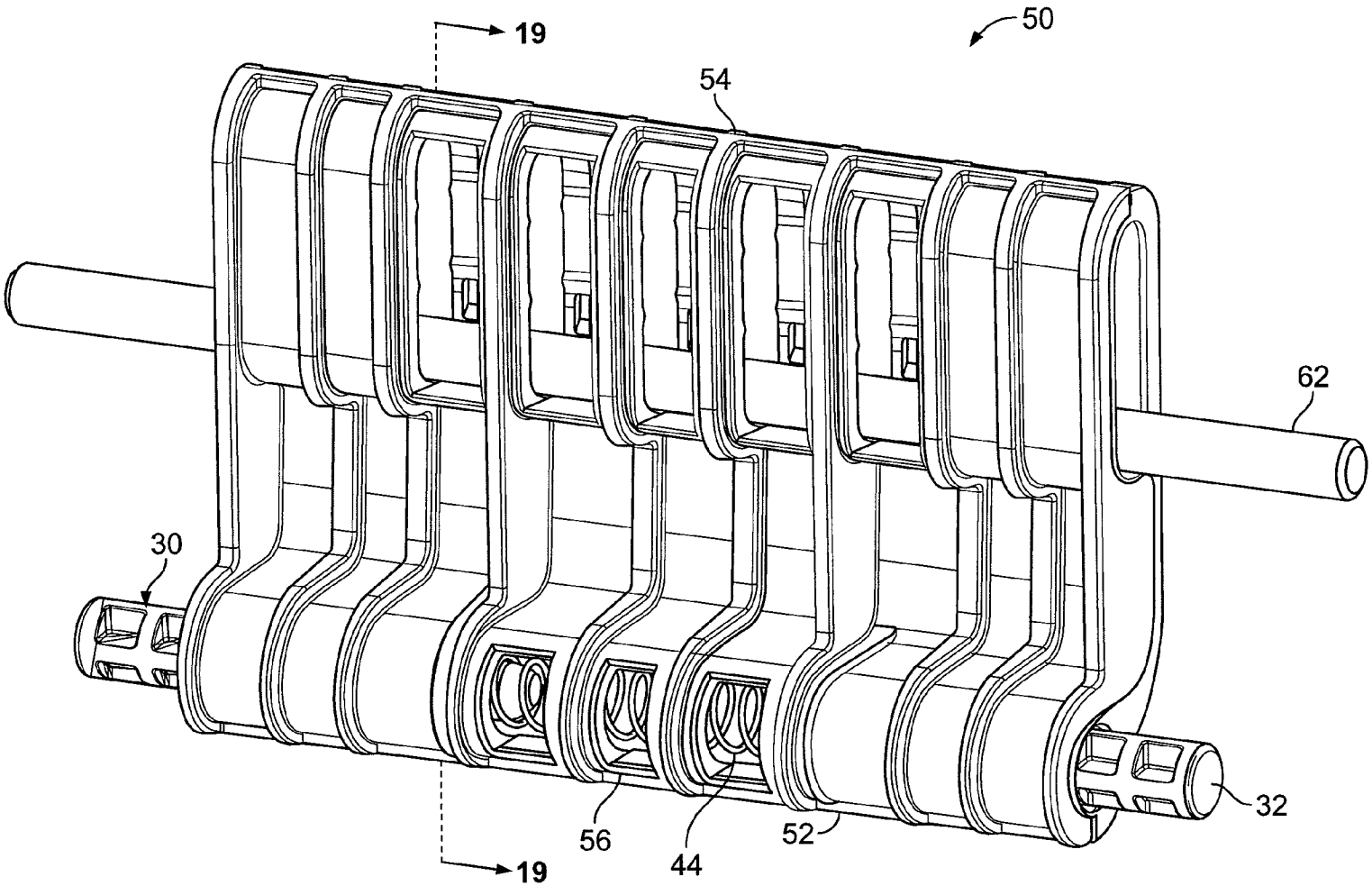
FIG. 18 is similar to FIG. 17, but shows the hinge leaf member assembly as viewed from the opposite side.
Figure 19A:
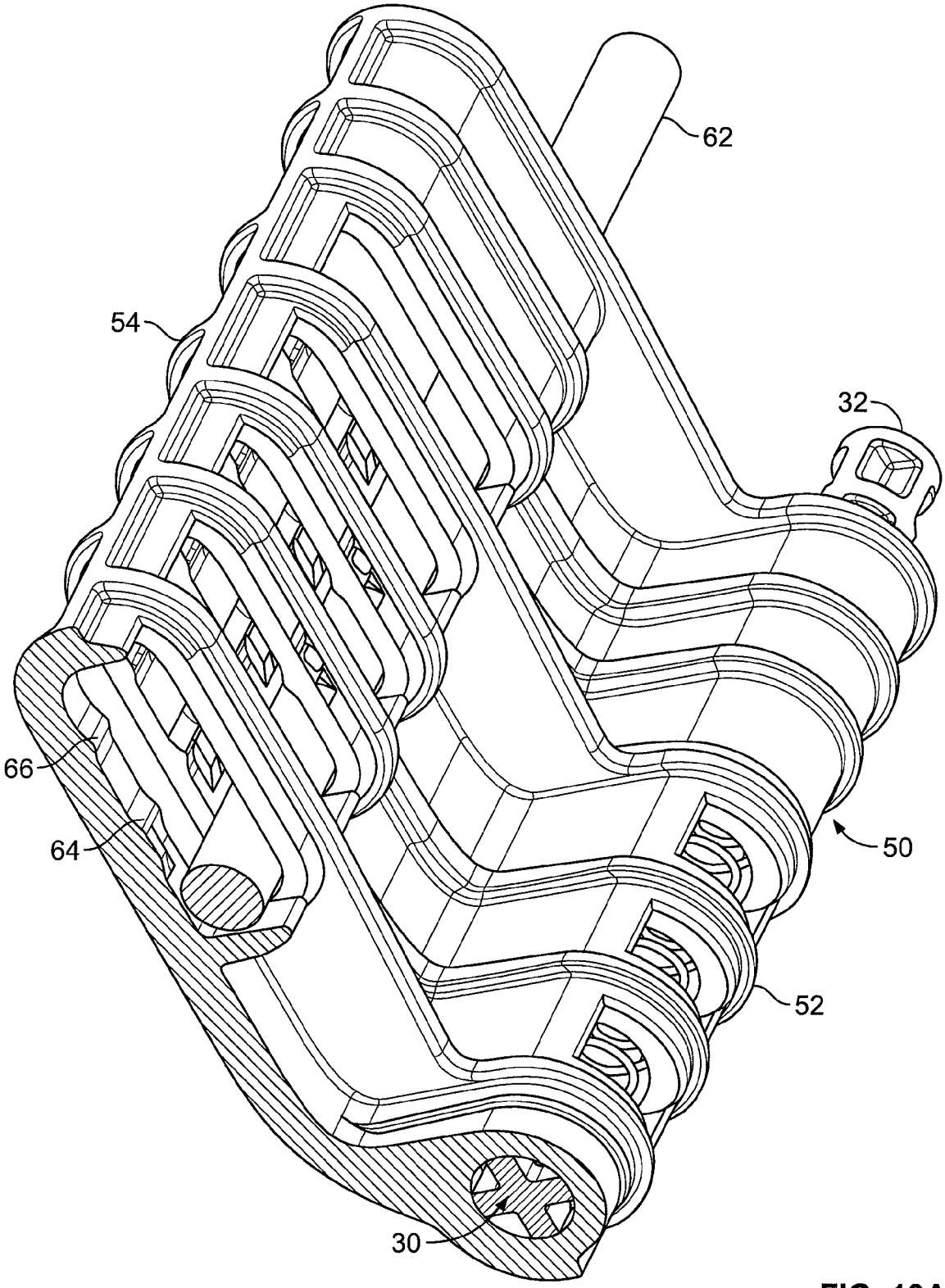
FIG. 19*a* is similar to FIG. 18, but is a perspective view from a different angle, showing a section cut through the assembly at line 19-19 of FIG. 18.
Figure 19B:
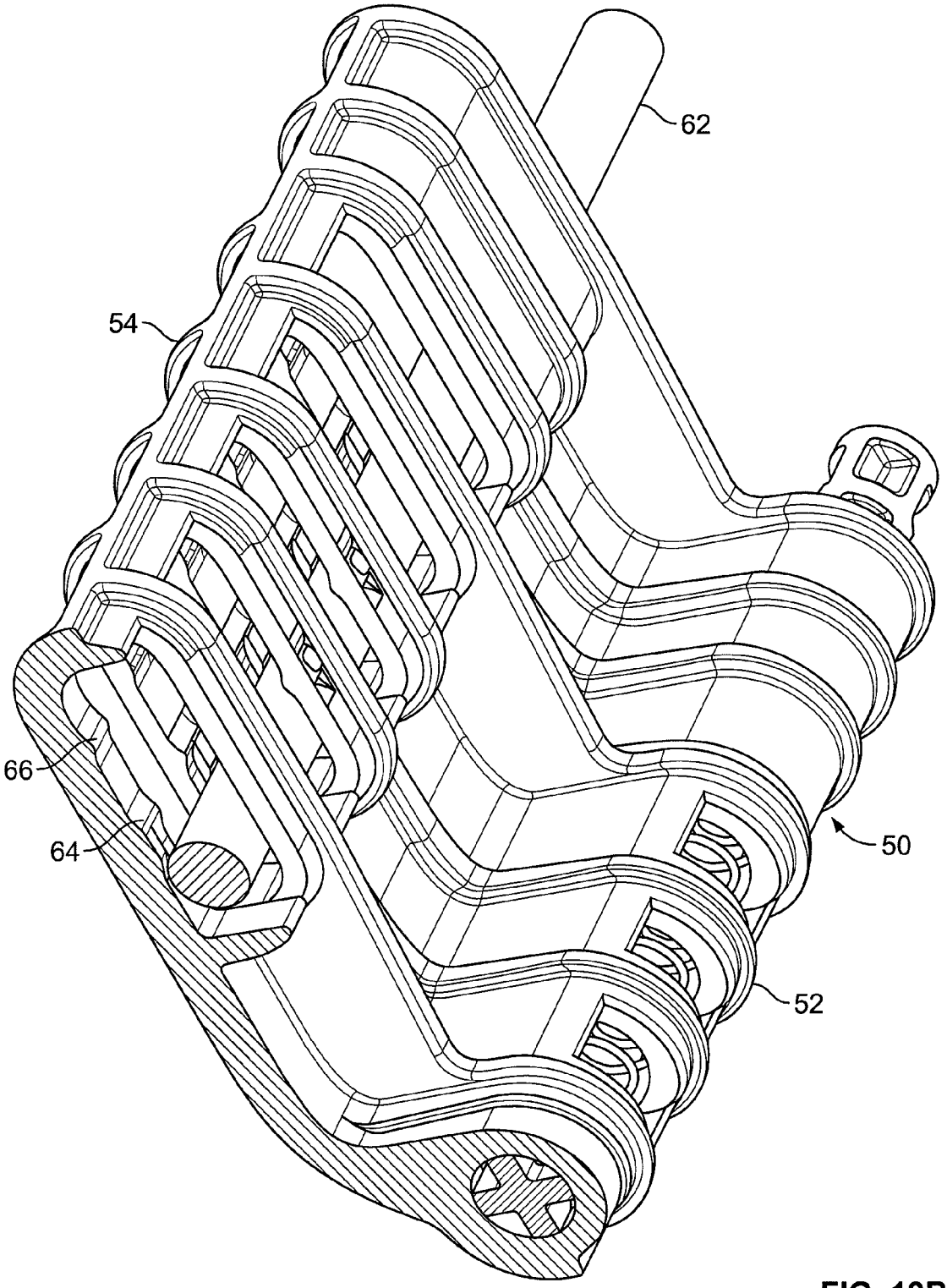
Figure 19C:
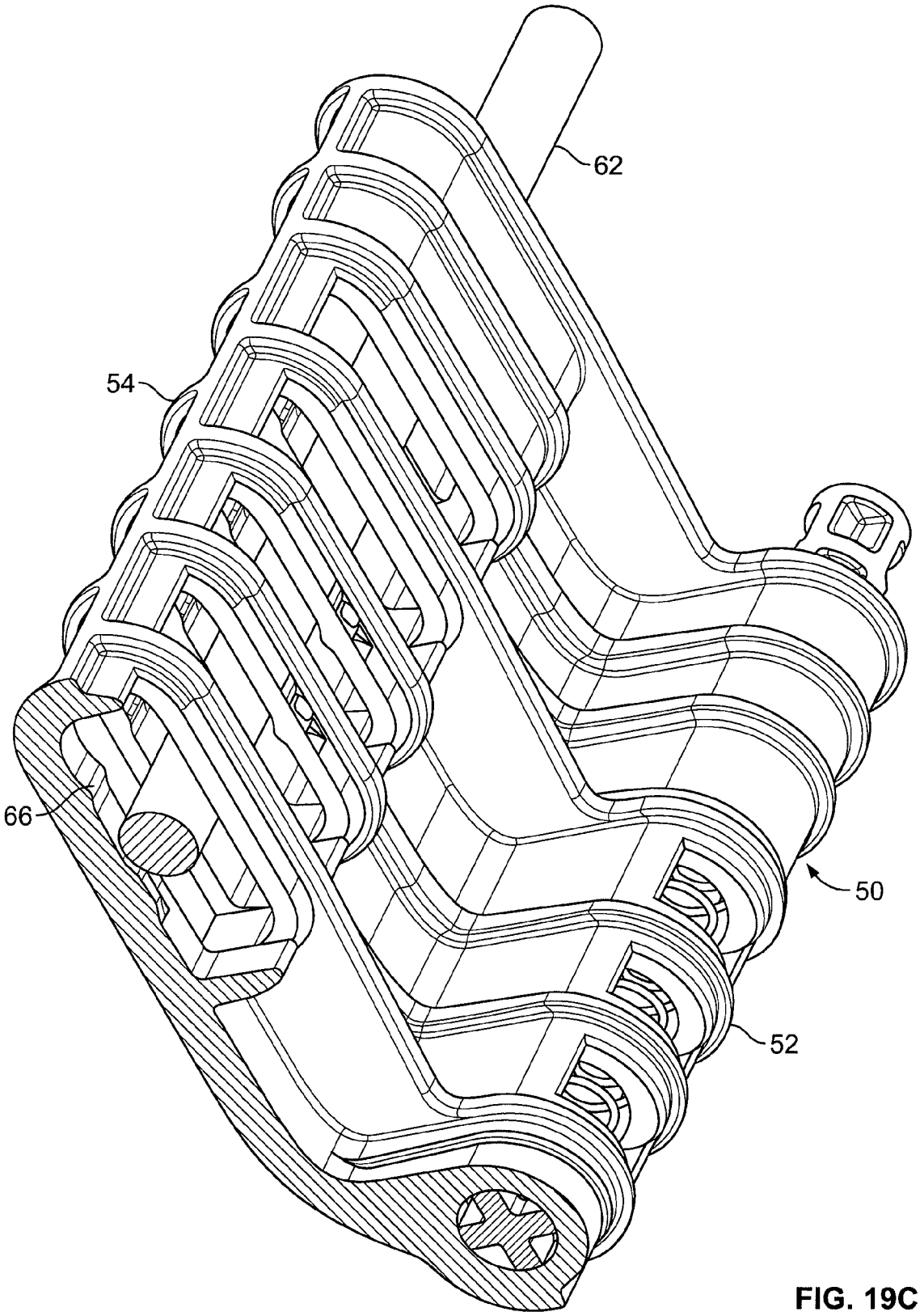
Figure 19D:
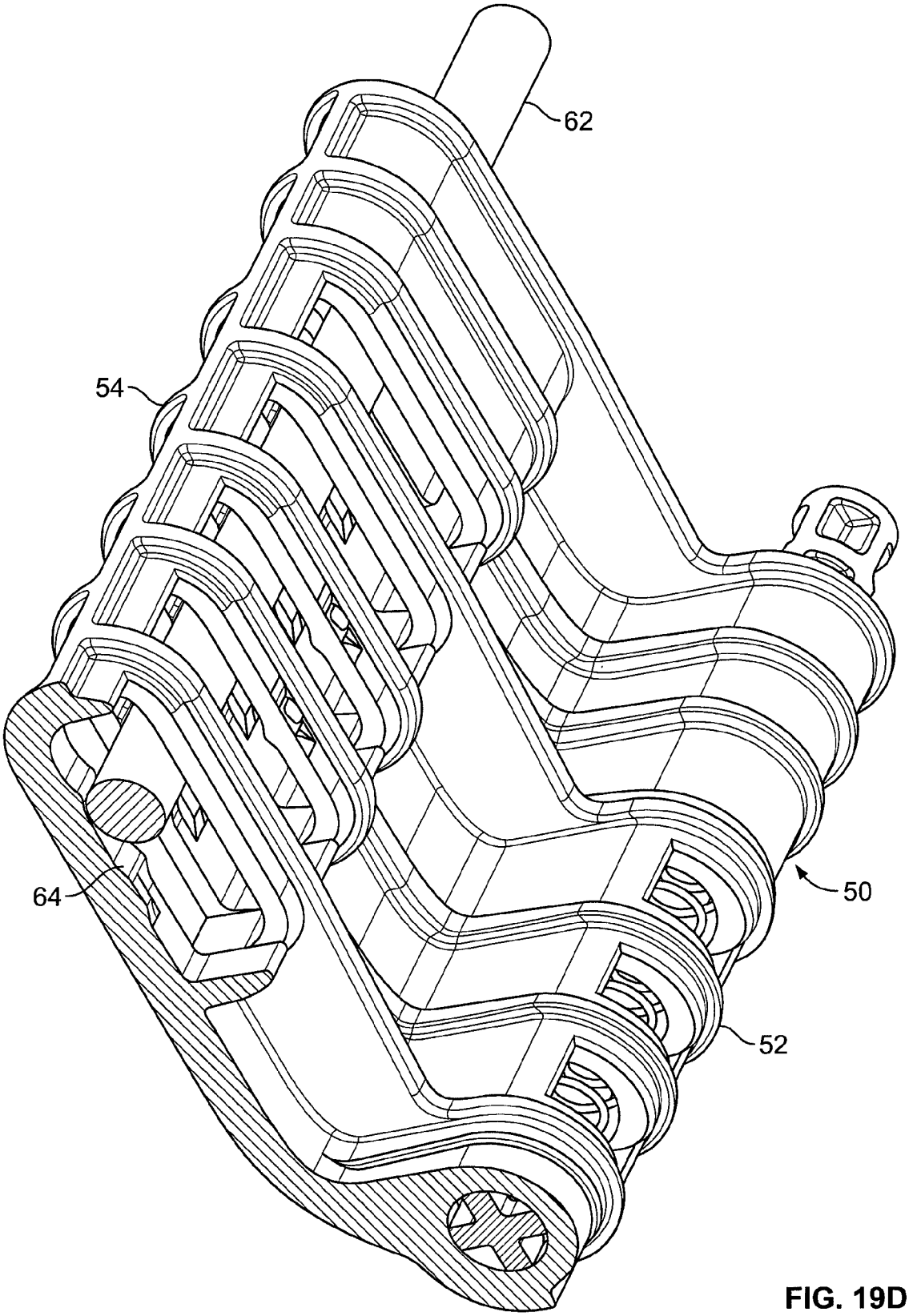

As further shown in FIGS. 17-22, the first portion 52 of member 50 preferably is similar in many respects to the leaf member 22 of FIGS. 2-4. An opening 55 is provided to receive one or more pin head members 30 and spring members 44. Access ports 56 and detent engagement areas 58 are provided near the center of the portion 52, to facilitate retention of the pin head members and spring member (via interference of detents 36 with corresponding detent engagement areas 58) and selective retraction of the pin head members into the member 50 by compressing the spring member 44. As indicated above, such retraction can occur (as illustrated in FIG. 18) by using a key or screwdriver or similar implement, or even a user's finger, to reach in through the opening 56 and slide the respective pin head members toward the center of first portion 52.

Portion 54 is preferably integrally molded with section 52 via an appropriately strong web of flanges and similar structures, and includes a slot 60 extending therethrough. As with the other components in the preferred embodiment, various ribbing patterns can be formed on the member 50 for shape retention, ease of molding and the like.

Slot 60 preferably is configured to slidingly receive a non-collapsible hinge pin 62. Pin 62 preferably is relatively stiff and tough, to provide the functions described herein for hinging and retaining the drop door 100 in its desired relationship with the sidewall. Among other things, pin 62 can be pultruded, extruded, or injection molded, and is preferably of generally uniform cross-section along its length.

Preferably, pin 62 is relatively free-floating within the opening 60, to permit the desired relative movements of the drop door 100 and the sidewall in which the drop door is mounted. When assembled with the drop door 100 and the intermediate leaf member 50, constrictions on movement of the pin 62 preferably include the sides of the slot 60 generally, detents 64 and 66 formed thereon, and end stops 140 and 142 (see FIG. 25).

Although the leaf member 50 is illustrated as having the spring-loaded hinge pin portion 52 engaged with the sidewall and the floating hinge portion 54 engaged with the drop door, persons of ordinary skill in the art will understand that, in one of the many alternative embodiments of the invention (not shown), the hinge could be reversed so that the floating hinge portion 54 engaged with the sidewall and the spring-loaded hinge pin portion 52 engaged with the drop door.

Figure 22:
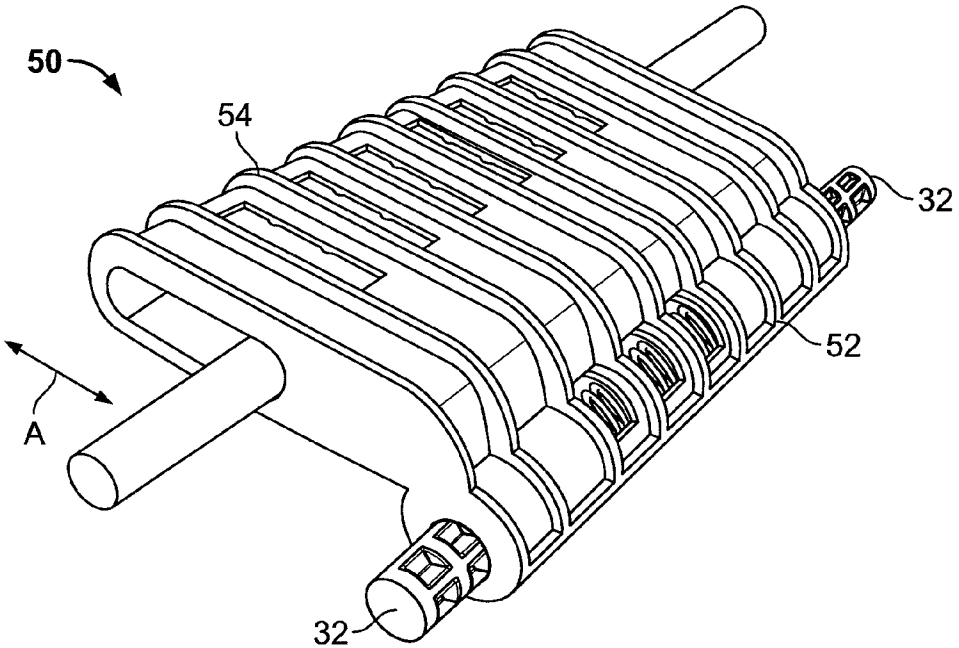
FIG. 22 is similar to FIGS. 18 and 19*a-e*, in that it illustrates a preferred articulate hinge leaf member assembly of the invention, with an arrow indicating the "floating" movement through which the non-collapsible hinge pin can traverse.
Figure 23:
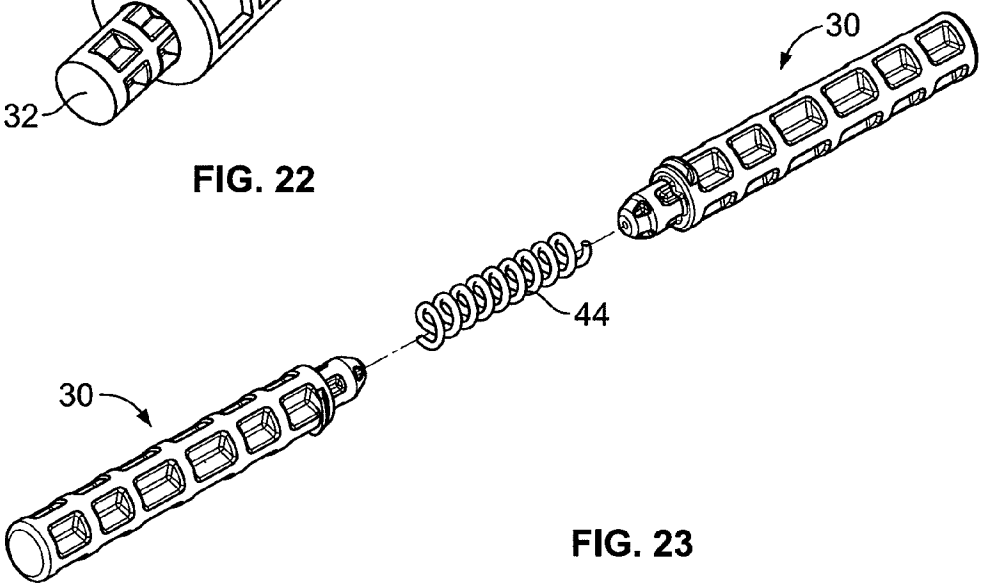
FIG. 23 is an exploded view of two pin head members and a spring member, oriented as they are within the hinge leaf member of FIG. 22.
Figure 26A:
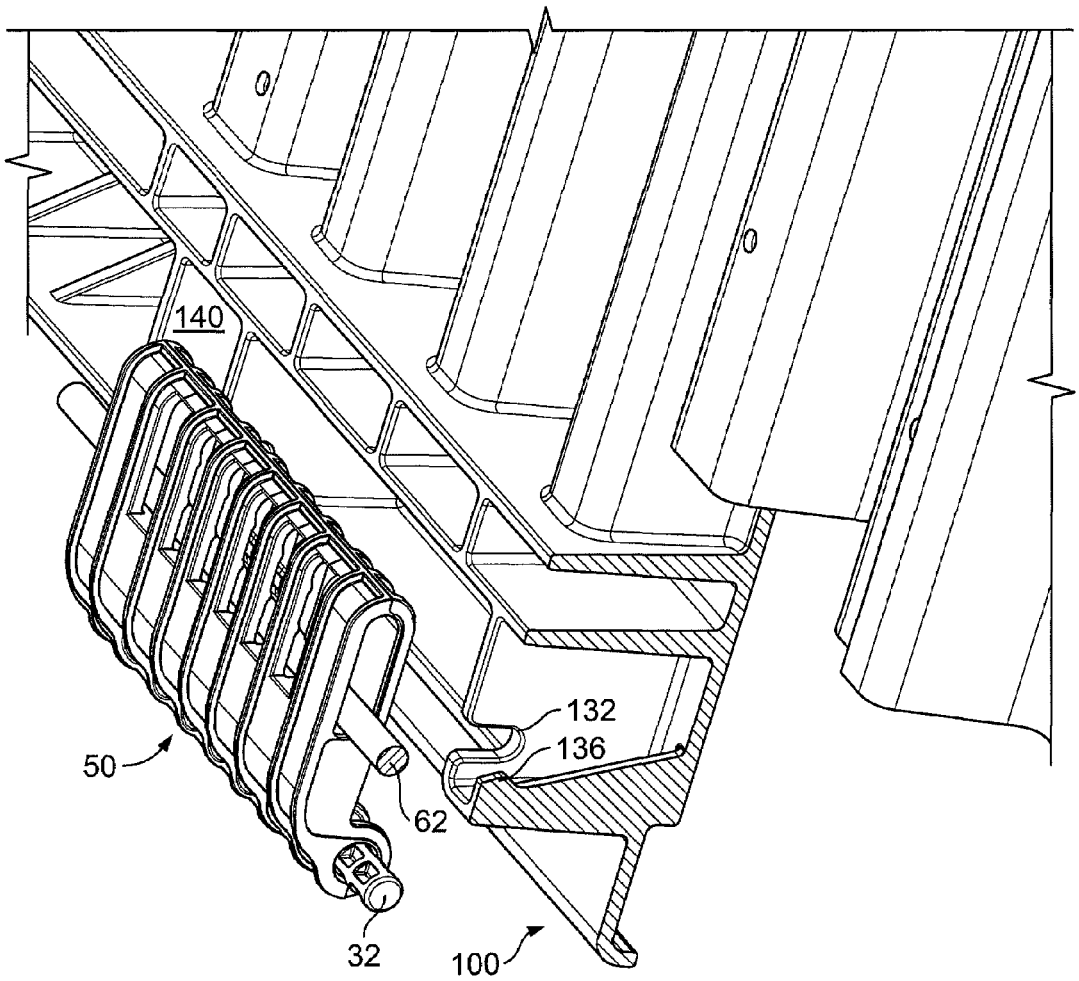
FIGS. 26*a-d* are similar to FIG. 25, with the drop door in partial cutaway, and illustrate the gradual insertion of the non-collapsible hinge rod into engagement with the drop door.
Figure 26B:
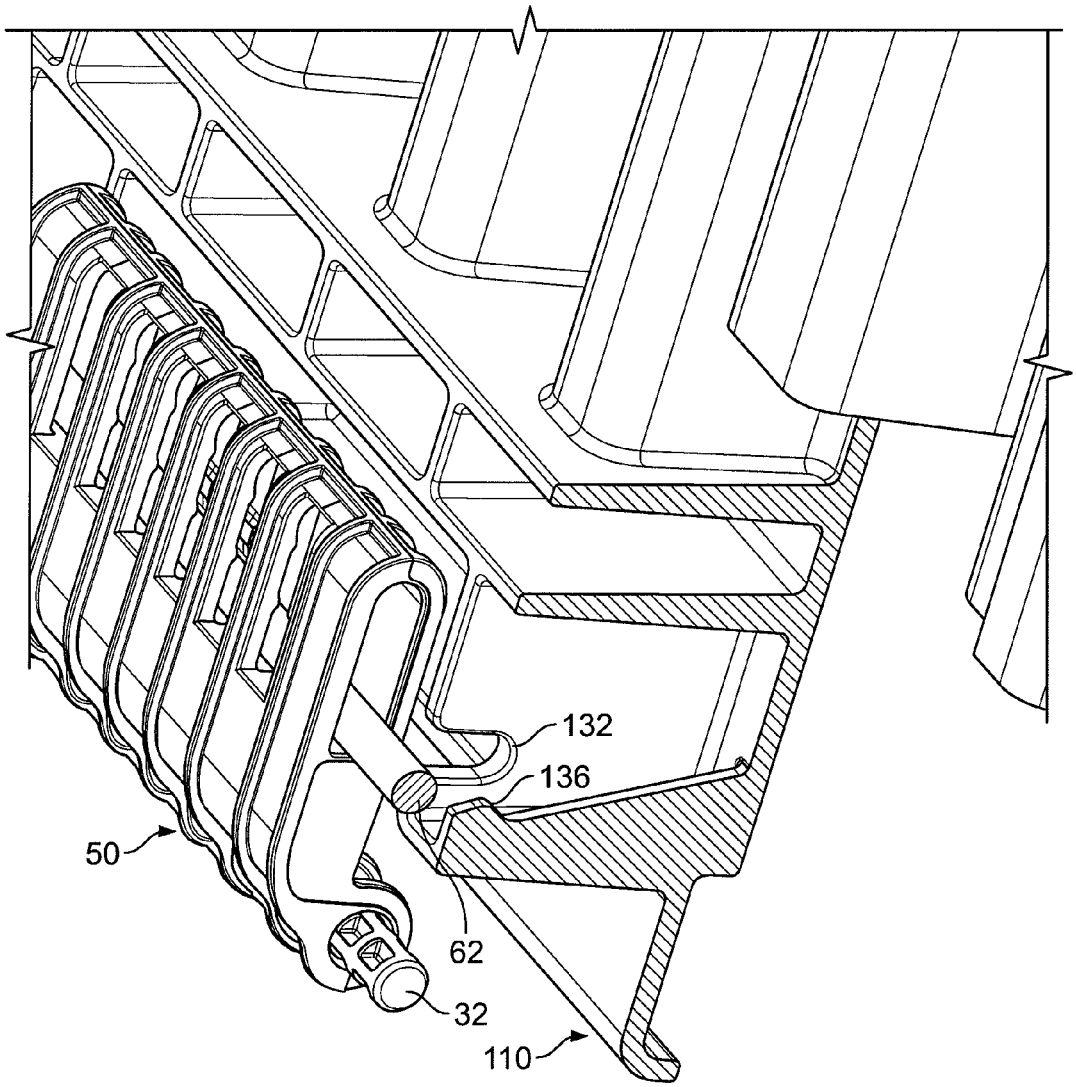
Figure 26C:
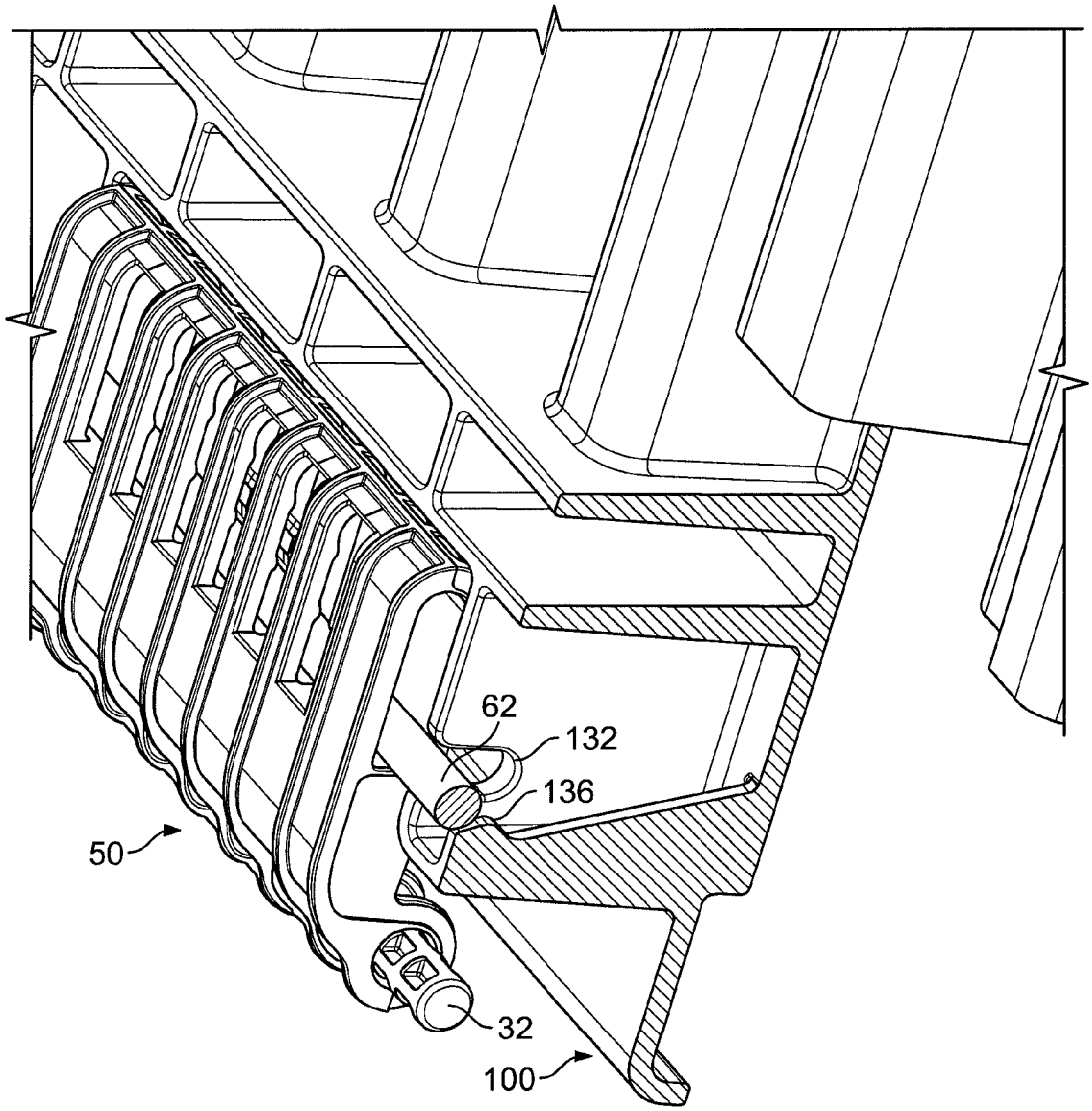
Figure 26D:
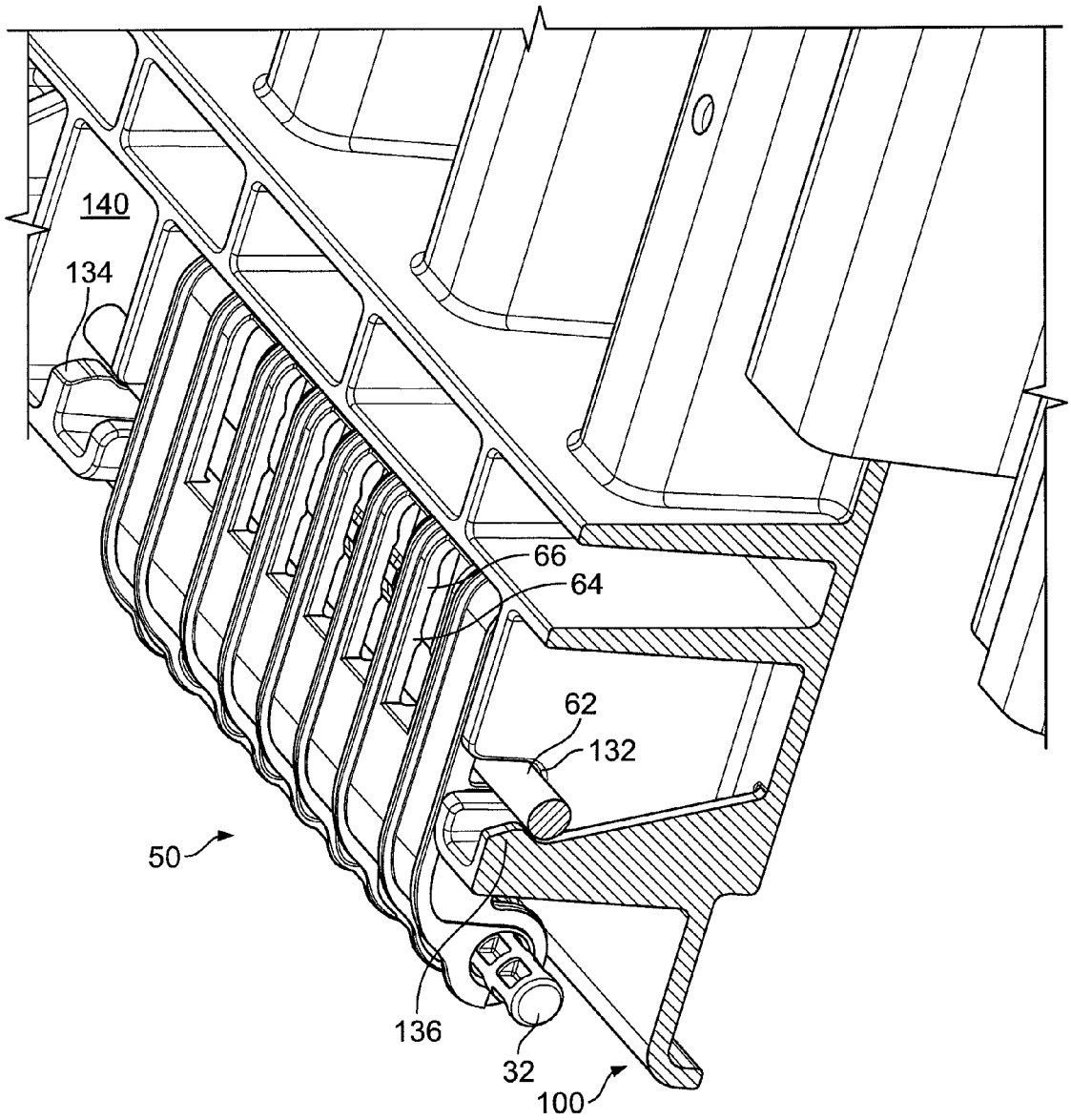
Figure 27:
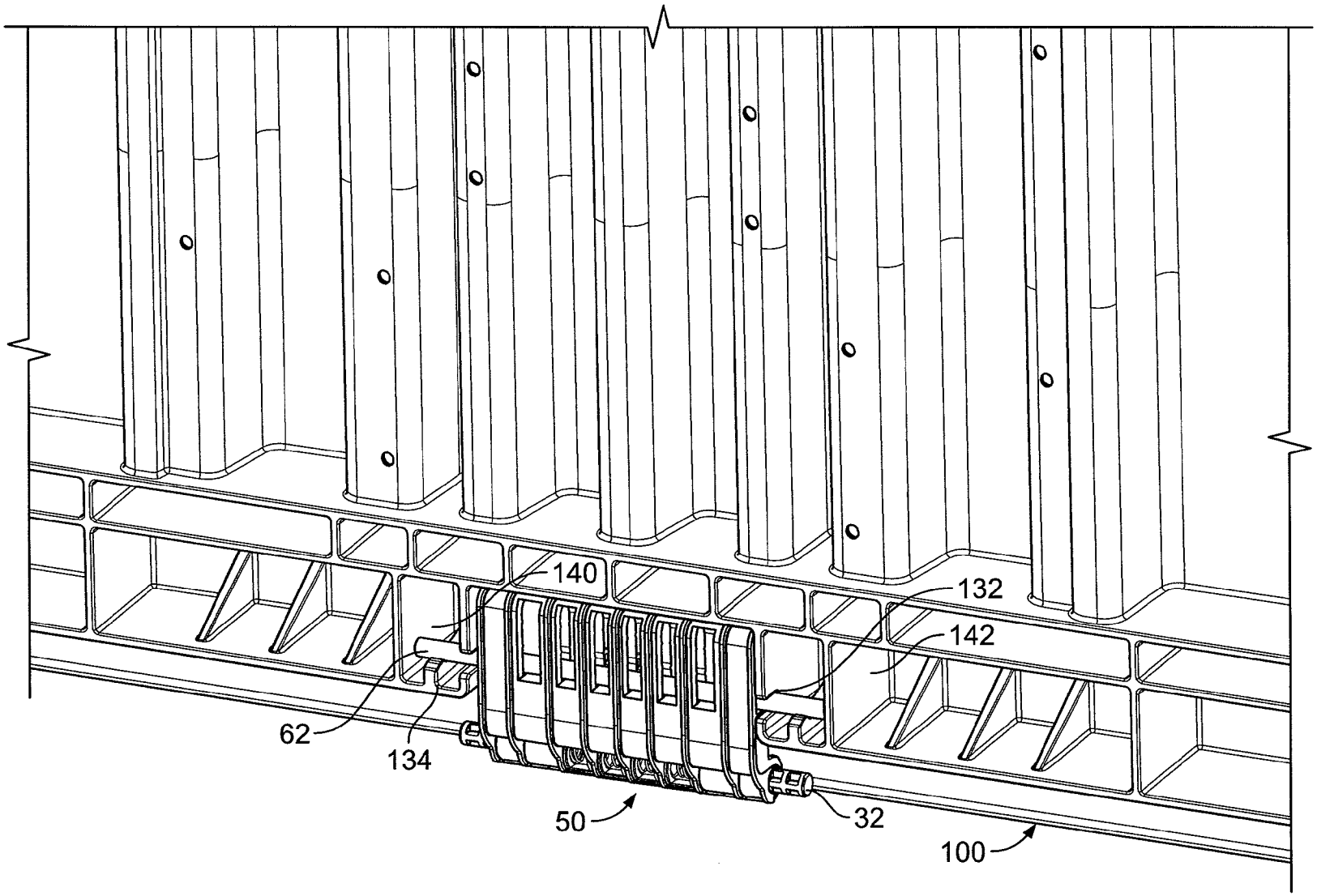
FIG. 27 is similar to FIG. 25, but show the non-collapsible hinge rod and its associated hinge leaf member assembly engaged with the drop door.
Figure 28:
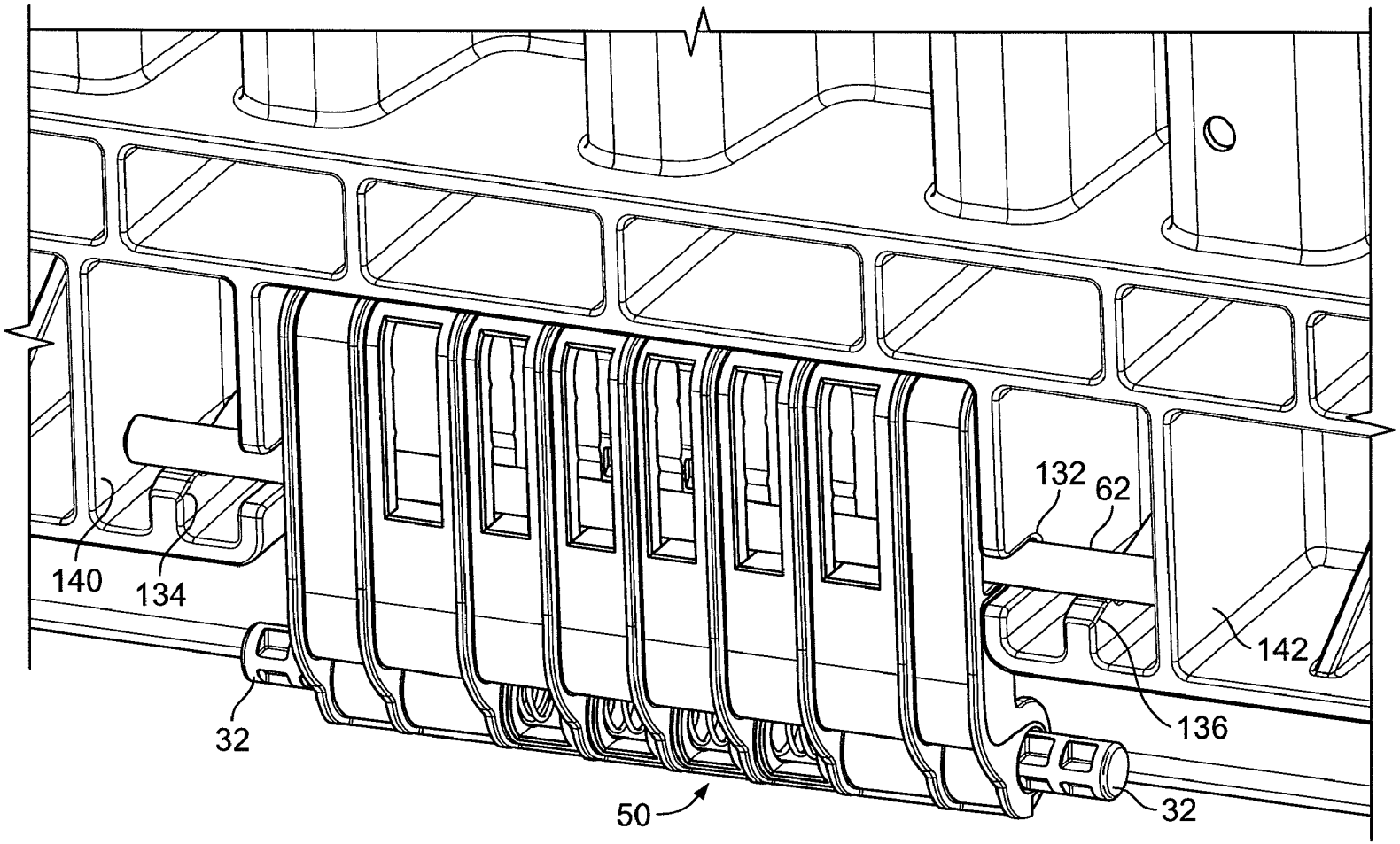
FIG. 28 is a close-up view of the bottom center portion of FIG. 27.
Figure 29:
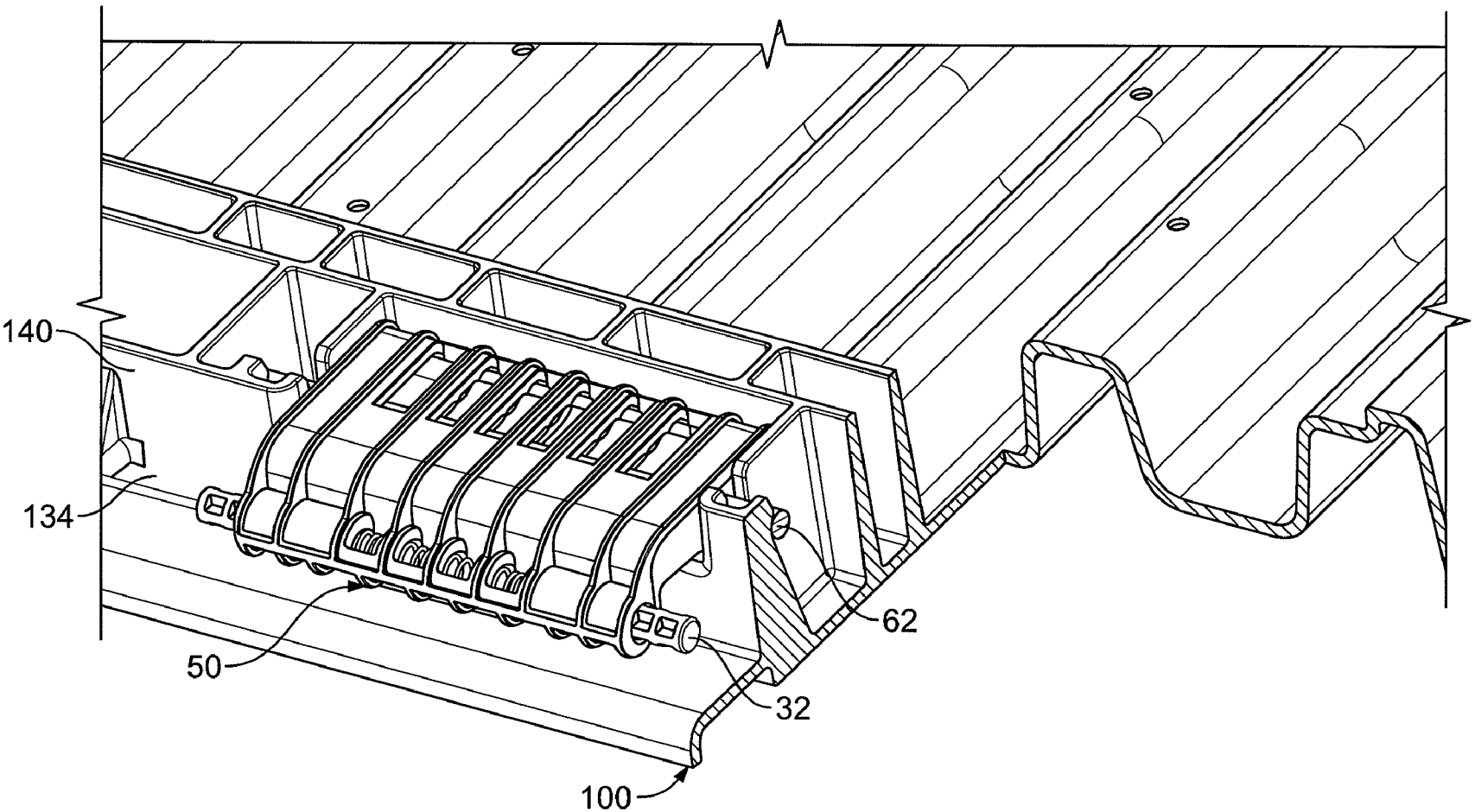
FIG. 29 is similar to FIG. 28, but with the drop door in partial cutaway, and from a slightly lower viewing angle.

Once the hinge assembly 50 is engaged with the sidewall and drop door 100, lifting the drop door relative to the sidewall preferably causes the non-collapsible hinge pin 62 to gradually traverse the slot 60 as illustrated in the sequence of FIGS. 19*a-e* and by the arrow A in FIG. 22. The pin 62 and the detents 64 and 66 preferably are configured to require a user to exert some degree of force to move the pin 62 over detents 64 and eventually all the way past detents 66. Among other things, that interfering relationship between detents 64 and 66 and the pin 62 keeps the drop door from falling back toward the sidewall, in that a user has to exert similar force to push the pin 62 back in that other direction. In turn, this retention of pin 62 at a raised position within slot 60 facilitates opening of the drop door and related movements of the drop door 100. As shown in FIG. 26*d*, detents 64 can also help keep the leaf member 50 from falling undesirably away from the drop door 100.

Figure 20:
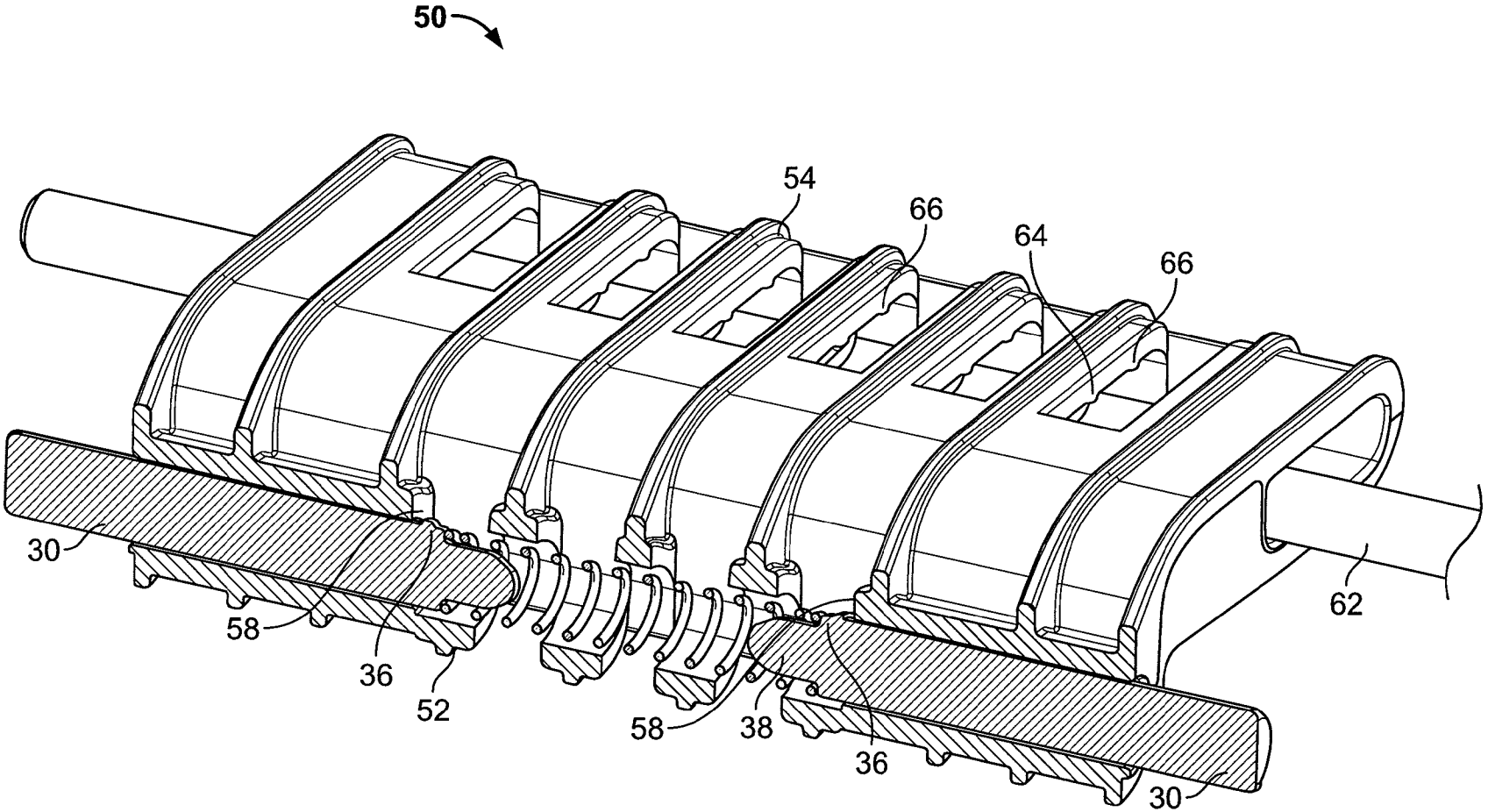
FIG. 20 is similar to FIG. 17, but is from a slightly different angle and includes a section view cut through the pin head members and spring element and associated body of the hinge leaf member.
Figure 21:
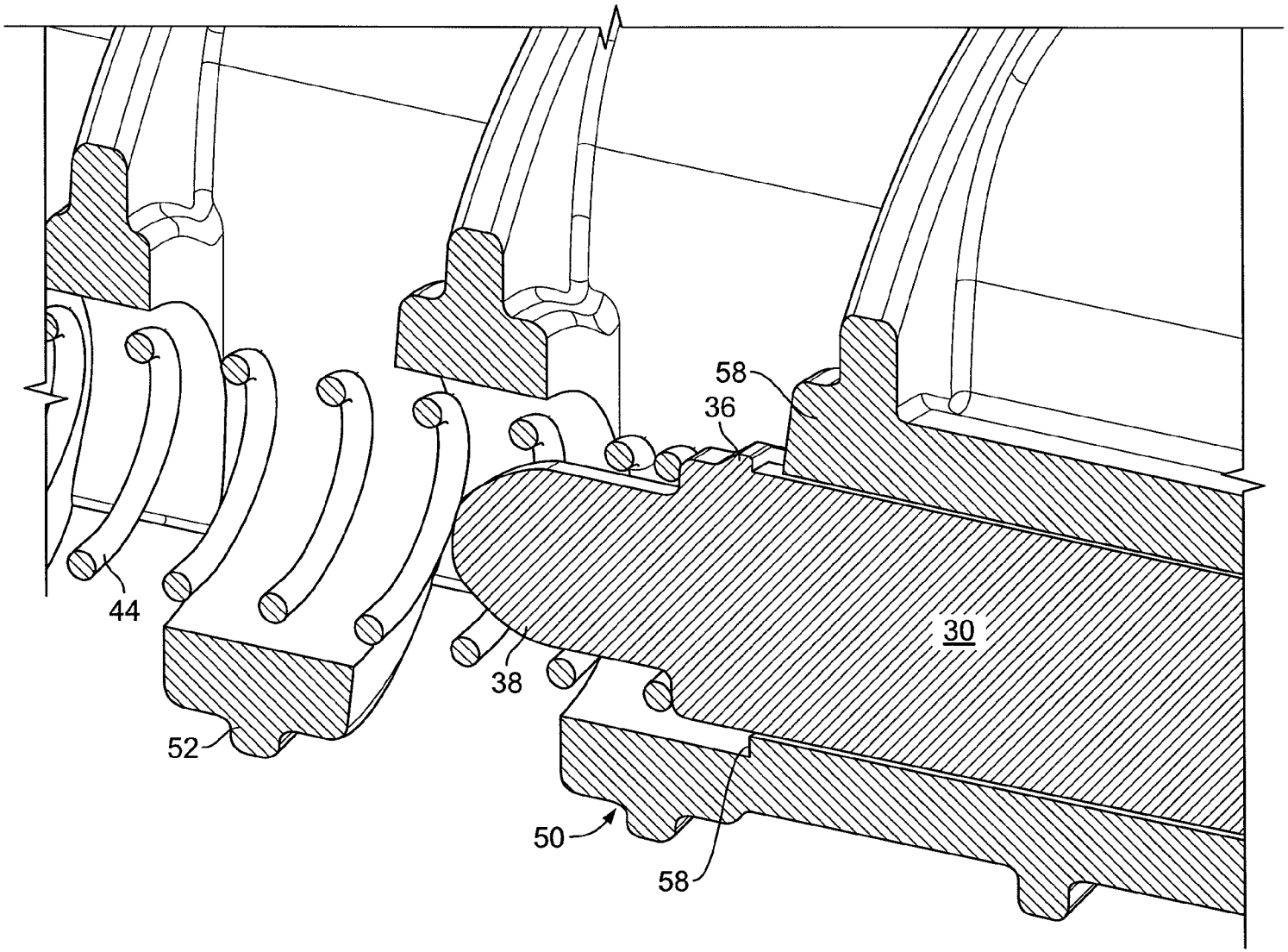
FIG. 21 is a close up view of a portion of FIG. 20, including the left end of the right pin head member.

FIGS. 20 and 21 illustrate the preferred interaction of the detents 36 on the pin head members 30 with the detent engagement areas 58. Preferably, those elements form an interference fit that makes it difficult to remove the pin head members 30 once they have been inserted in the intermediate member 50. A preferred method of assembly includes forming the leaf member 50 from plastic and, while it is still somewhat soft and pliable, forcing the pin head members 30 and spring member 44 into the position shown in FIG. 20. After the member 50 fully cools, it typically will also shrink slightly, making it even more difficult to remove the pin head members 30 from the leaf member 50. In such embodiments, if the pin head members 30 do become damaged (from designed stress relief failures or otherwise), it will typically be more time- and cost-efficient to remove and replace the entire hinge assembly 50 than to try to remove and replace only the pin head members.

The preferred engagement of the leaf member assembly 50 with the drop door is illustrated in FIGS. 24-30. Preferably, slots 130 and 132 are provided to receive the pin 62. In order to seat the pin 62 within the slots 130 and 132, however, preferably the pin 62 must be forced over detents 134 and 136. In the preferred embodiment, this can be done by aligning the pin 62 properly and applying a sharp blow with the palm of one's hand, by carefully striking the assembly 50 with a rubber mallet, or the like. The assembly 50 preferably snaps into engagement with the drop door 100 (see FIGS. 26*a-d* for a sequential depiction of this engagement, resulting in the pin 62 being fully seated in the slots 130 and 132, as shown in FIG. 26*d*).

Figure 30:
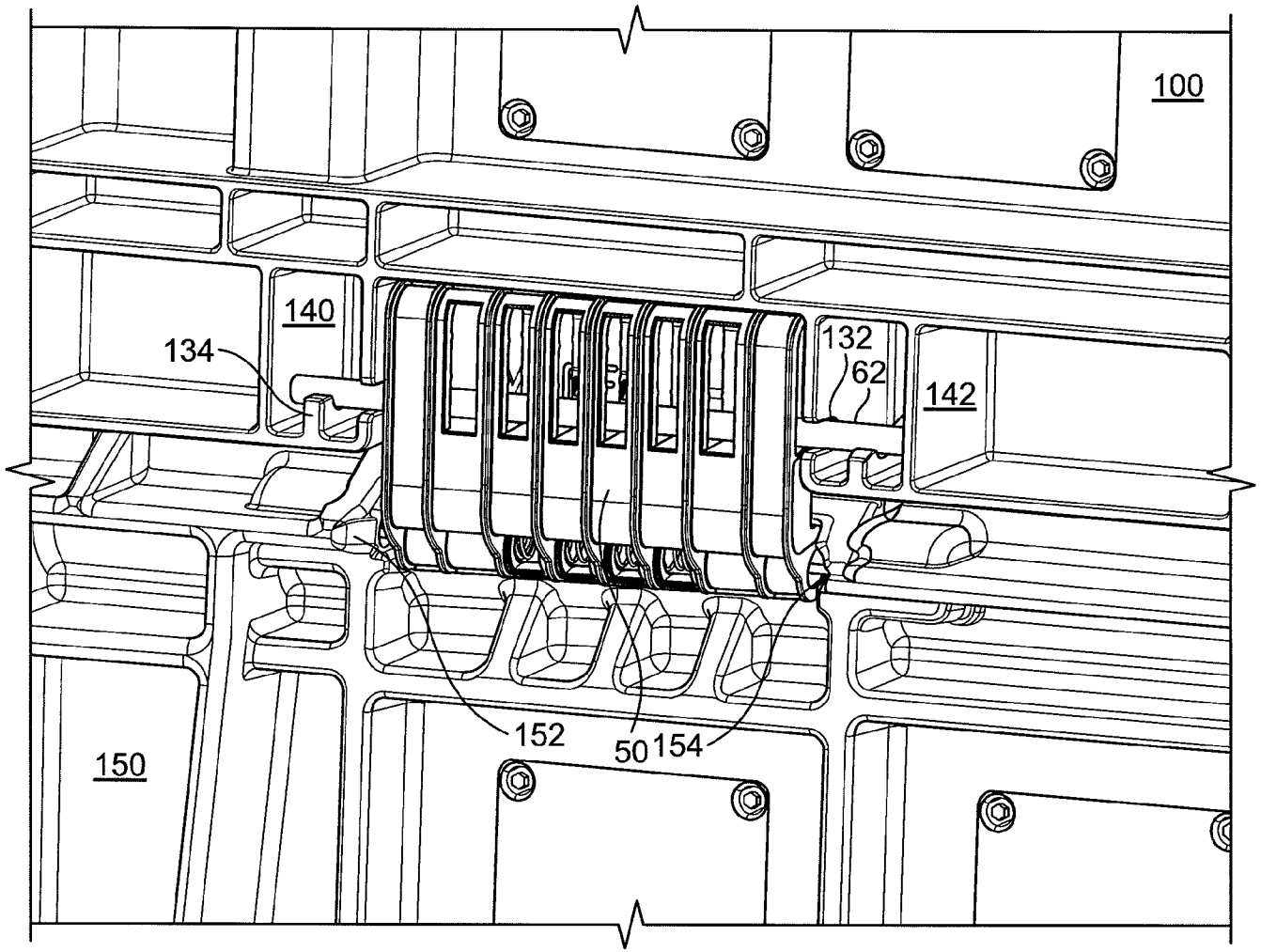
FIG. 30 is similar to FIG. 27, but shows the hinge leaf member assembly engaged with the drop door and the sidewall.
Figure 31:
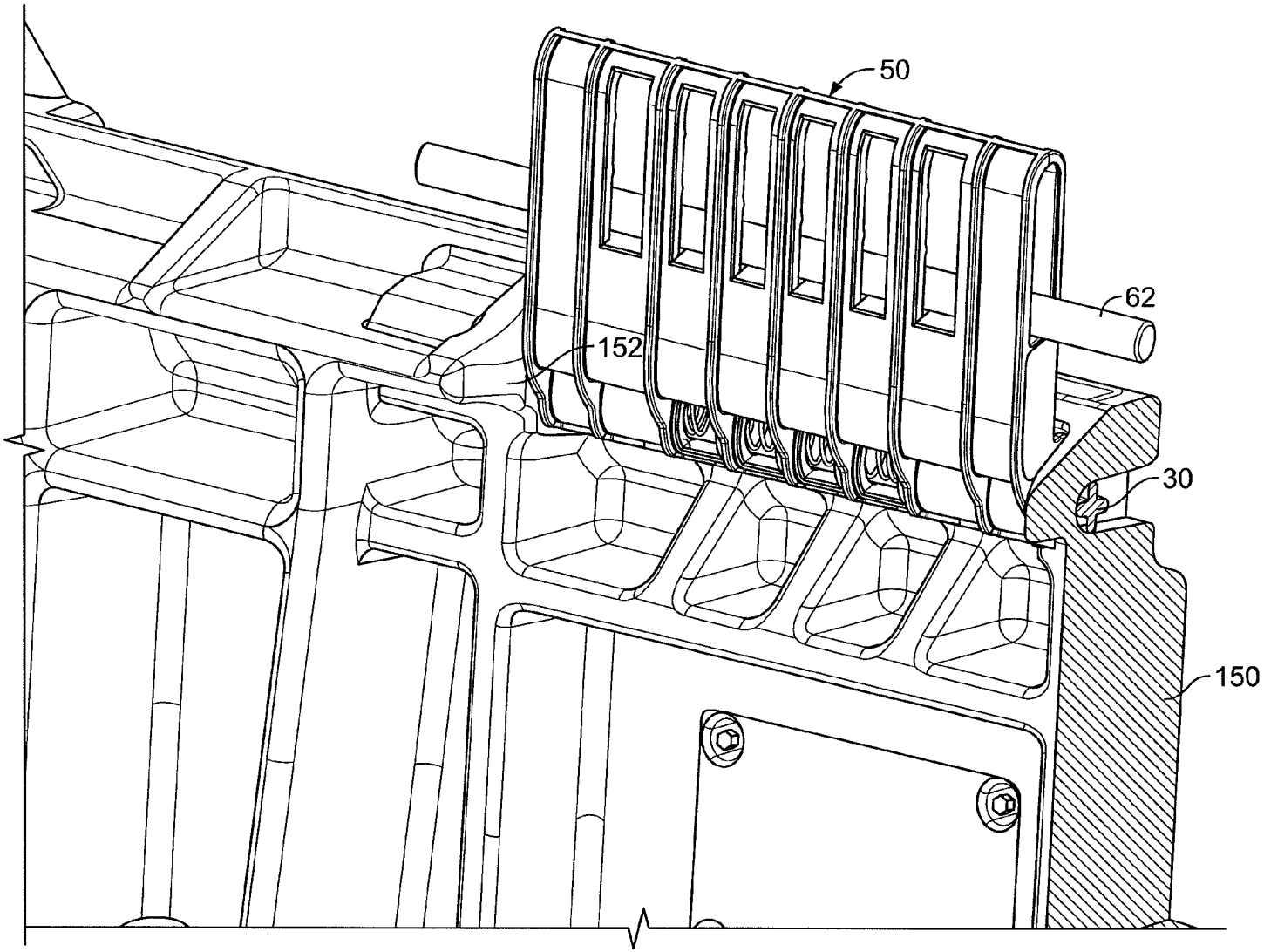
FIG. 31 is similar to FIG. 30, but with the drop door in partial cutaway, and with the drop door not shown.
Figure 32:
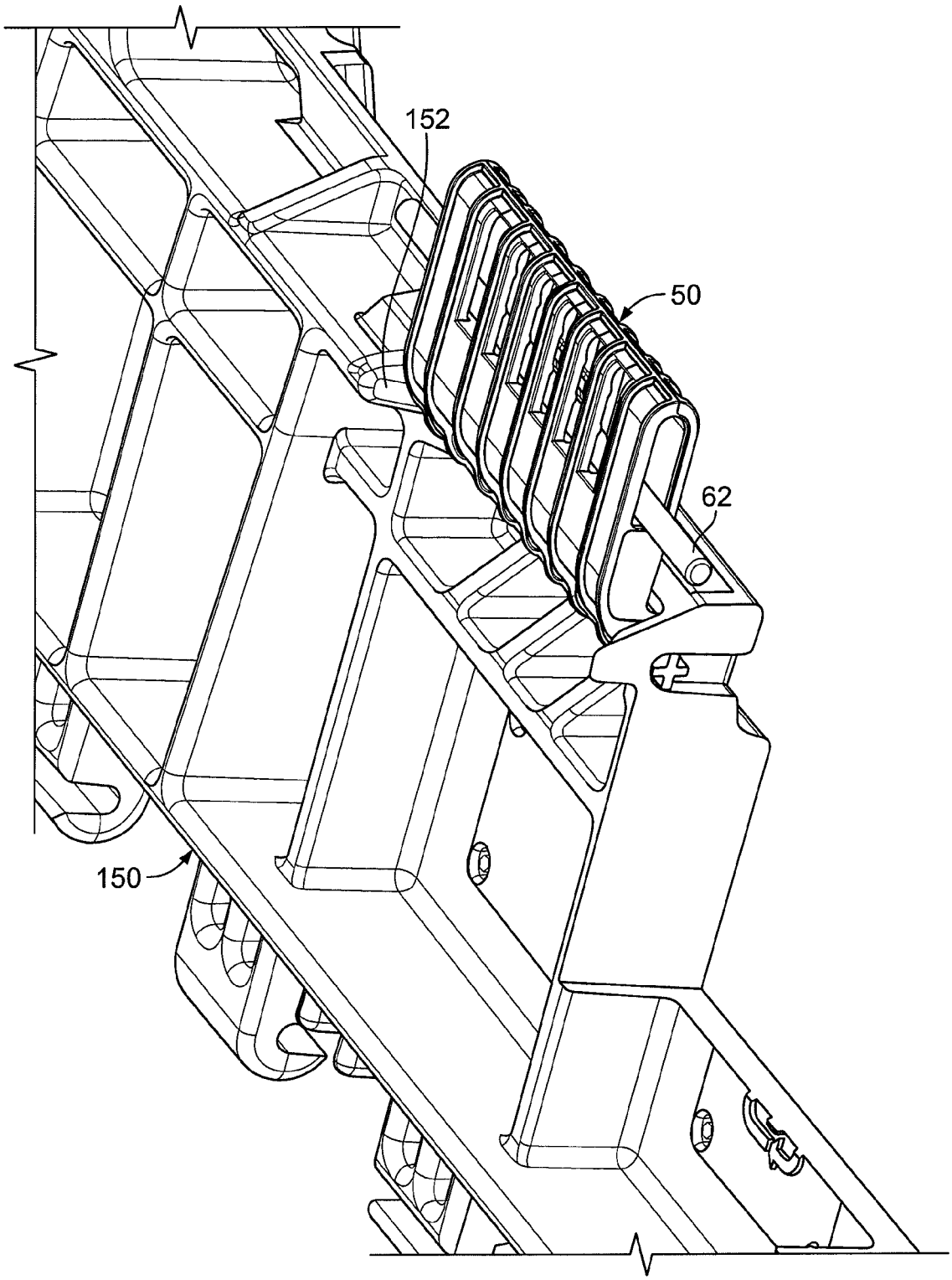
FIG. 32 is similar to FIG. 31, but from a viewing angle that is slightly higher and to the right.

FIGS. 30-32 illustrates the full assembly of the drop door 100, the leaf member 50, and a base member 150. Among other things, pin head guide surfaces 152 and 154 preferably are provided on the sidewall to force the pin head members 30 to compress the spring member 44 as the leaf portion 50 is pushed into desired alignment with the sidewall 150. Persons of ordinary skill in the art will understand that, among the many embodiments of the invention, the sidewall 150 could also use the spring-loaded hinge aspects of the invention to attach to the container base, even for sidewalls having drop doors therein.

Figure 33:
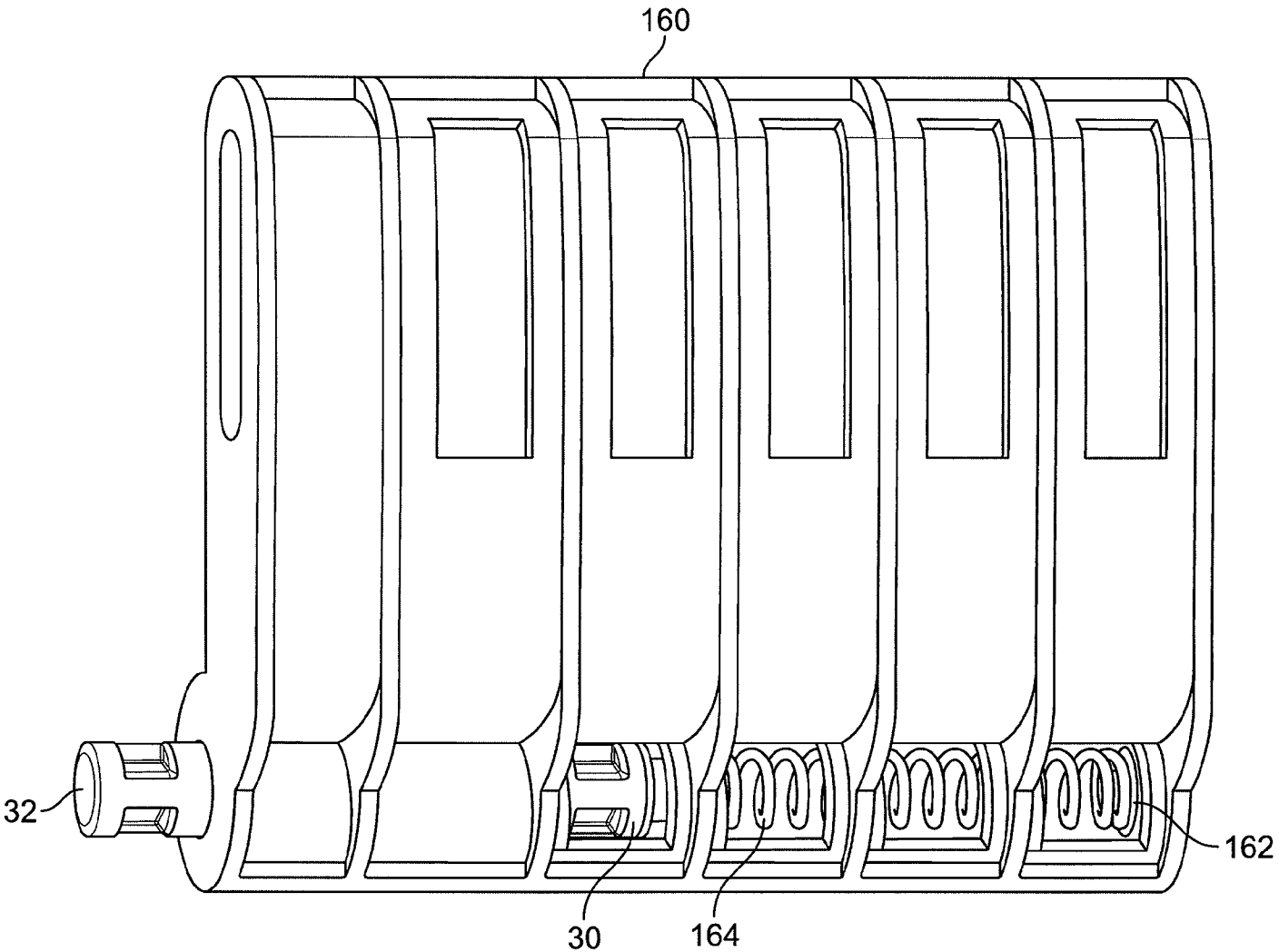
FIG. 33 illustrates one of the many alternative embodiments of an articulated hinge structure embodiment of the invention, having only one pin head member and having the opposite end of its spring member in contact with a wall portion of the hinge leaf member.

As mentioned above, FIG. 33 illustrates another of the many alternative embodiments of the invention. In FIG. 33, a housing 160 holds a single pin head member 30, which compresses a single spring member 164 against a flange 162.

Figure 34:
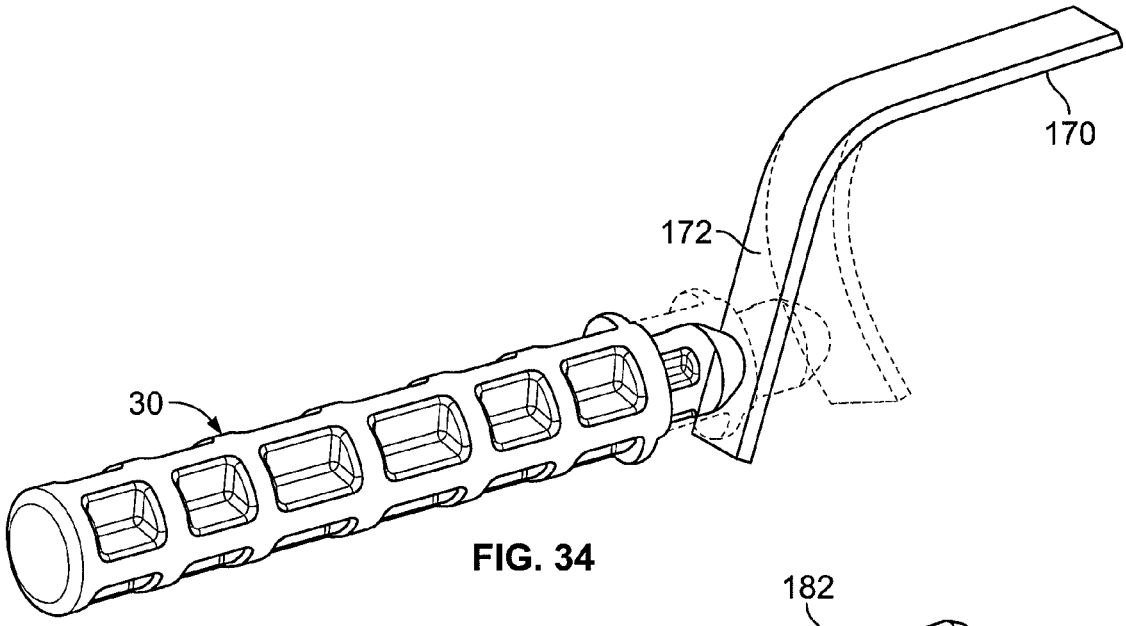
FIG. 34 illustrates another of the many alternative embodiments of the invention, indicating one of the many embodiments that the spring member can take.

FIG. 34 illustrates yet another alternative embodiment of the invention, in which the spring member forcing the pin head member 30 out of the housing comprises a plastic arm 170 molded as an integral part of the hinge and/or sidewall. Flexing portion 172 preferably is fabricated from a material having sufficient spring memory to urge the pin head member 30 outward (to the position shown in dark lines), but can be deflected to the position shown in phantom lines, for retraction of the pin head member, etc. This spring 170 can be integrally formed as part of the hinge leaf 50 or 160, the sidewall, the container base or other components.

Figure 35:
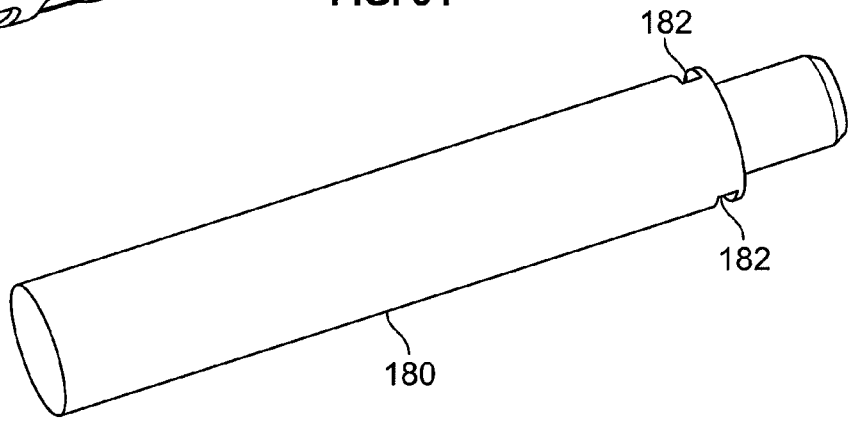
FIG. 35 and FIG. 36 illustrate some of the many alternative embodiments of the pin head member of the invention.
Figure 36:
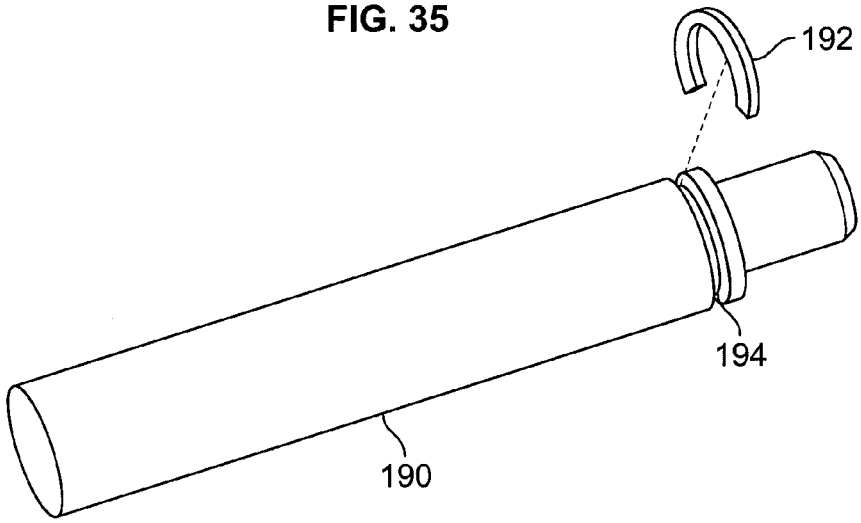

FIGS. 35 and 36 illustrate some of the many alternative embodiments of pin head members useful in the invention. FIG. 35 shows a pin head member 180 having a generally solid cylindrical body and small detents 182 (this embodiment might be made, for example, from steel and have stamped detents 182). FIG. 36 shows a similar pin head member 190 with the detent provided by a collar 192 that preferably is snapped into engagement in a channel 194 formed in the member 190.

The apparatus and methods of my invention have been described with some particularity, but the specific designs, constructions and steps disclosed are not to be taken as delimiting of the invention. Obvious modifications will make themselves apparent to those of ordinary skill in the art, all of which will not depart from the essence of the invention and all such changes and modifications are intended to be encompassed within the appended claims.

What is claimed is:

1. A hinge apparatus, including a leaf portion, a first pin head member housed in said leaf portion, and a spring member forcing an end of said first pin head member to extend from said leaf portion, and said pin head member hinges a sidewall fabricated from plastic to a container base fabricated from plastic, and a second pin head member housed in said leaf portion, in which said first and second pin head members extend coaxially in opposite directions from each other and are forced to extend in their respective directions by a single-spring element positioned between them.

2. The hinge apparatus of claim 1 in combination with at least one other hinge apparatus of claim 1, in which said first and second pin head members of all such hinges are coaxially aligned along a side of the sidewall and the container base.

3. The hinge apparatus of claim 1, including a second hinge rod member within said leaf portion, the axis of rotation of said second hinge rod member in spaced parallel alignment with the axis of rotation of said first pin head member.

4. The hinge apparatus of claim 3, in which said second hinge rod member is a non-collapsible rod.

5. The hinge apparatus of claim 4, in which said non-collapsible rod can float transversely to said axes of rotation within a slot formed in said leaf portion.

6. The hinge apparatus of claim 5, further including detent means within said slot to temporarily hold said non-collapsible rod at a selected location within said slot while permitting hinged rotation about said non-collapsible rod.

7. The hinge apparatus of claim 1 or claim 2, in which said first and second pin head members of all such hinges are coaxially aligned along a side of the container sidewall.

8. The hinge apparatus of claim 7, including an access port adjacent each spring member to allow ready compression of said spring member and corresponding disengagement of said sidewall from said container base.

9. The hinge apparatus of claim 1 or claim 2, including an access port adjacent each pin head member to allow ready compression of said spring member and corresponding axial movement of said pin head member back toward said leaf portion.

10. The hinge apparatus of claim 3, in which said second hinge rod member includes a third pin head member housed in said leaf portion, further including a second spring member forcing an end of said third pin head member to extend from said leaf portion.

11. The hinge apparatus of claim 10, including a fourth pin head member housed in said leaf portion, and said second spring member also forces an end of said fourth pin head member to extend from said leaf portion coaxially in an opposite directions from said third pin head member.

12. A method of hinging a first collapsible container member fabricated from plastic to a second collapsible container member fabricated from plastic, including providing a hinge apparatus including a leaf portion, a first pin head member housed in said leaf portion, and a spring member forcing an end of said first pin head member to extend from said leaf portion, with said leaf portion operably affixed to said first collapsible container member, compressing said spring member to permit said first pin head member to retract toward said leaf portion, aligning said first pin head member with a corresponding opening in said second collapsible container member, and allowing said spring member to force said end of said first pin head member to extend from said leaf portion into said corresponding opening in said second collapsible container member.

13. The hinge apparatus of claim 1, further including detent means acting between said first pin head member and said leaf portion to keep said spring member from forcing said first pin head member out of said leaf portion.

14. A method of fabricating the hinge apparatus of claim 13, including:

providing said detent means on said first pin head member;

molding said leaf portion to include a generally round opening therein, said round opening configured to closely fit and support said first pin head member in a rotatable relationship, said leaf portion further including a detent receiving structure remote from said end of said first pin head member, said round opening comprising an interference fit with respect to said detent on said first pin head member; and forcing said detent on said first pin head member through said interference fit to engage said first pin head member with said leaf portion.

15. The method of claim 14, further including the step of inserting a the spring member into said round opening prior to forcing said detent on said first pin head member through said interference fit.

16. The method of claim 14 or claim 15, including taking said step of forcing said detent on said first pin head member through said interference fit while said leaf portion is still pliable from said molding step.

17. Apparatus for removably engaging a sidewall fabricated from plastic to a container base fabricated from plastic, including a first pin head member housed in said sidewall, and a spring member forcing an end of said first pin head member to normally extend from said sidewall into engagement with said container base, said spring member being selectively collapsible to permit disengagement of said end of said first pin head member from said container base, and a second pin head member housed in said side wall, in which said first and second pin head members extend coaxially in opposite directions from each other and are forced to extend in their respective directions by a single-spring element positioned between them.

18. The hinge apparatus of claim 1 in combination with at least one other hinge apparatus, in which said first and second pin head members of all such hinges are coaxially aligned along a side of a first element to be hinged to a second element.

19. A hinge apparatus, including a leaf portion, a first pin head member housed in said leaf portion, and a spring member forcing an end of said first pin head member to extend from said leaf portion, and said pin head member hinges a sidewall fabricated from plastic to a container base wherein the pinhead includes a plurality of pockets.

* * * * *

UNITED STATES PATENT AND TRADEMARK OFFICE

CERTIFICATE OF CORRECTION

PATENT NO. : 7,331,480 B1
APPLICATION NO. : 10/256631
DATED : February 19, 2008
INVENTOR(S) : Roger Nolan It is certified that error appears in the above-identified patent and that said Letters Patent is hereby corrected as shown below:

Column 12, line 9, before "spring" delete "the".

Column 12, line 39, after "base" insert -- fabricated from plastic --.

Signed and Sealed this

Thirty-first Day of August, 2010

David J. Kappos

David J. Kappos
*Director of the United States Patent and Trademark Office*